US010353422B2

(12) United States Patent
Poirier et al.

(10) Patent No.: US 10,353,422 B2
(45) Date of Patent: Jul. 16, 2019

(54) BIDIRECTIONAL PEDAL ASSEMBLY

(71) Applicant: Kongsberg Power Products Systems I, Inc., Willis, TX (US)

(72) Inventors: Ronda Poirier, Ballston Spa, NY (US); Anthony Bugamelli, Conroe, TX (US); Aaron Hengst, Willis, TX (US); Jesse Henrikson, Conroe, TX (US)

(73) Assignee: KONGSBERG POWER PRODUCTS SYSTEMS I, INC., Willis, TX (US)

( * ) Notice: Subject to any disclaimer, the term of this patent is extended or adjusted under 35 U.S.C. 154(b) by 21 days.

(21) Appl. No.: 15/737,925

(22) PCT Filed: Jun. 23, 2016

(86) PCT No.: PCT/US2016/038965
§ 371 (c)(1),
(2) Date: Dec. 19, 2017

(87) PCT Pub. No.: WO2016/210095
PCT Pub. Date: Dec. 29, 2016

(65) Prior Publication Data

US 2018/0196459 A1 Jul. 12, 2018

Related U.S. Application Data

(60) Provisional application No. 62/183,432, filed on Jun. 23, 2015.

(51) Int. Cl.
*G05G 1/44* (2008.04)
*G05G 5/05* (2006.01)
(Continued)

(52) U.S. Cl.
CPC ..... *G05G 1/445* (2013.01); *G05G 1/44* (2013.01); *G05G 1/487* (2013.01); *G05G 5/03* (2013.01); *G05G 5/05* (2013.01)

(58) Field of Classification Search
CPC ..... G03G 1/445; G03G 1/487; G03G 1/44; G03G 1/38; G03G 5/03; G03G 5/05;
(Continued)

(56) References Cited

U.S. PATENT DOCUMENTS 2,083,940 A * 6/1937 Burton ..... B60W 10/04 188/162
5,921,142 A 7/1999 Peter
(Continued)

FOREIGN PATENT DOCUMENTS

CN 103171531 A 6/2013
CN 103192710 B 7/2013
(Continued)

OTHER PUBLICATIONS

English language abstract for CN103171531 extracted from espacenet.com database on Sep. 19, 2018, 17 pages.
(Continued)

*Primary Examiner* — Luis A Gonzalez
(74) *Attorney, Agent, or Firm* — Howard & Howard Attorneys PLLC

(57) ABSTRACT

A bidirectional pedal assembly for a vehicle. The assembly includes a support mounted on the vehicle and a pedal pivotally coupled to the support about a pivot shaft. The pedal pivots between a neutral position and first and second operational positions. A biasing member is mounted within the support and continuously biases the pedal to the neutral position. A control mechanism is coupled to the support and the pedal to retard pivotal movement of the pedal as the pedal returns from the operational positions to the neutral position. A handle can be coupled to the pedal and pivot concurrently with the pedal. A frictional mechanism can be disposed within the support and provide increasing resistance as the pedal moves increasingly away from the neutral
(Continued)

position. The biasing mechanism, frictional mechanism, and/or control mechanism are configured to force the pedal to the neutral position with no overshoot within a predetermined period.

32 Claims, 19 Drawing Sheets

(51) Int. Cl.
*G05G 1/445* (2008.04)
*G05G 5/03* (2008.04)
*G05G 1/487* (2008.04)

(58) Field of Classification Search
CPC ..... G05G 1/445; G05G 1/487; G05G 1/44; G05G 1/38; G05G 5/03; G05G 5/05
See application file for complete search history.

(56) References Cited

U.S. PATENT DOCUMENTS

| | | | | |
|---|---|---|---|---|
| 6,109,133 | A * | 8/2000 | Kohlen | B60K 26/021 188/74 |
| 6,192,308 | B1 | 2/2001 | Onuma | |
| 6,591,712 | B2 | 7/2003 | Goto et al. | |
| 7,032,471 | B2 * | 4/2006 | Weber | B66F 9/20 74/469 |
| 7,040,447 | B1 * | 5/2006 | Mawhinney | G05G 1/487 180/315 |
| 7,458,311 | B2 | 12/2008 | Korthals | |
| 7,748,480 | B2 | 7/2010 | Loxterkamp et al. | |
| 8,459,137 | B1 | 6/2013 | McCoy et al. | |
| 9,027,597 | B2 * | 5/2015 | Kubo | E02F 9/2004 137/625.25 |
| 9,501,083 | B2 * | 11/2016 | Zhou | F02D 11/02 |
| 9,829,908 | B2 * | 11/2017 | Roberts | G05G 1/445 |
| 2003/0010147 | A1 * | 1/2003 | Maurer | G05G 1/30 74/469 |
| 2008/0173124 | A1 * | 7/2008 | Thiel | G05G 1/445 74/512 |
| 2012/0152053 | A1 * | 6/2012 | Kondo | F16F 9/145 74/513 |
| 2018/0253121 | A1 * | 9/2018 | Stuart | G05G 5/05 |

FOREIGN PATENT DOCUMENTS

| | | | | |
|---|---|---|---|---|
| CN | 203126814 | | 8/2013 | |
| CN | 203211107 | | 9/2013 | |
| CN | 203211300 | | 9/2013 | |
| CN | 104057345 | A | 9/2014 | |
| CN | 103129537 | B | 11/2014 | |
| CN | 204264398 | A1 | 4/2015 | |
| CN | 103192796 | B | 7/2015 | |
| EP | 0943835 | A2 | 9/1999 | |
| EP | 1588226 | A2 | 10/2005 | |
| JP | 3756069 | B2 | 3/2006 | |
| JP | 3756070 | B2 | 3/2006 | |
| JP | 5262449 | B2 | 8/2013 | |
| JP | 5285248 | B2 | 9/2013 | |
| WO | 200600907 | A1 | 1/2006 | |
| WO | 200732366 | A1 | 3/2007 | |
| WO | 201473294 | A1 | 5/2014 | |
| WO | WO-2014170126 | A1 * | 10/2014 | G05G 1/445 |

OTHER PUBLICATIONS

English language abstract for CN103192710 extracted from espacenet.com database on Sep. 19, 2018, 15 pages.
English language abstract for CN104057345 extracted from espacenet.com database on Sep. 19, 2018, 9 pages.
English language abstract for CN20311107 extracted from espacenet.com database on Sep. 19, 2018, 36 pages.
English language abstract for EP1588226 extracted from espacenet.com database on Sep. 19, 2018, 15 pages.
English language abstract for JP3756070 extracted from espacenet.com database on Sep. 19, 2018, 14 pages.
English language abstract for JP3756069 extracted from espacenet.com database on Sep. 19, 2018, 12 pages.
English language abstract for JP5262449 extracted from espacenet.com database on Sep. 19, 2018, 13 pages.
English language abstract for JP5285248 extracted from espacenet.com database on Sep. 19, 2018, 17 pages.
English language abstract for WO200732366 extracted from espacenet.com database on Sep. 19, 2018, 23 pages.
English language abstract for WO201473294 extracted from espacenet.com database on Sep. 19, 2018, 54 pages.
English language abstract for CN204264398 extracted from espacenet.com database on Sep. 19, 2018, 10 pages.
English language abstract for CN203126814 extracted from espacenet.com database on Sep. 19, 2018, 15 pages.
English language abstract for CN203211300 extracted from espacenet.com database on Sep. 19, 2018, 16 pages.
English language abstract for CN103192796 extracted from espacenet.com database on Sep. 19, 2018, 17 pages.
English language abstract for CN103129537 extracted from espacenet.com database on Sep. 19, 2018, 8 pages.

* cited by examiner

BIDIRECTIONAL PEDAL ASSEMBLY

CROSS-REFERENCE TO RELATED APPLICATIONS

The present application is the National Stage of International Patent Application No. PCT/US2016/038965, filed on Jun. 23, 2016, which claims priority to and all the benefits of U.S. Provisional Patent Application No. 62/183,432, filed on Jun. 23, 2015, each of which is hereby expressly incorporated by reference in its entirety.

FIELD OF THE DISCLOSURE

The present disclosure relates to a bidirectional pedal assembly for a vehicle.

BACKGROUND OF THE DISCLOSURE

Bidirectional pedal systems are often used in vehicular applications (for example trucks and utility vehicles) to control vehicle operations. Such pedal systems typically include a bidirectional pedal assembly (also known as an over-center rocker pedal) configured to move relative to a fixed base between first and second operational positions opposite a neutral position. Upon release of an applied force by an operator, the pedal assembly returns to the neutral position under the influence of one or more biasing elements associated with the assembly. Other than the biasing elements urging the pedal assembly to the neutral position, the assembly is generally unconstrained from moving between the first and second operational positions through the neutral position. The arrangement can undesirably result in oscillations about the neutral position, particularly upon increasing the size and/or weight of the pedal assembly, and/or connecting structures to the pedal assembly that increase torque about the fixed base.

Such concerns are pronounced in the context of bidirectional pedal systems utilizing electronic sensors. The angular position of the pedal assembly relative to the fixed base is sensed by an electronic sensor, after which the position signal of the sensor is transmitted electronically to a controller configured to generate a corresponding control command. Should the pedal assembly oscillate about or "overshoot" the neutral position, unintended position signals are transmitted to the electronic control unit of the engine or other electronically controlled operation. Such signals can result in unnecessary throttle demand or deficient throttle demand to the vehicle. Therefore, there is need in the art for an improved bidirectional pedal systems that returns to neutral position while preventing oscillation about or overshoot of the neutral position.

SUMMARY OF THE DISCLOSURE

According to an exemplary embodiment of the present disclosure, a bidirectional pedal assembly for a vehicle includes a support configured to be mounted on the vehicle, a pivot shaft disposed within the support, and a pedal pivotally coupled to support about the pivot shaft. The pedal pivots between a neutral position, a first operational position, and a second operational position. The second operational position is opposite the first operational position relative to the neutral position. A handle operably is coupled to the pedal and configured to pivot concurrently with the pedal. A biasing member is mounted within the support and continuously biasing the pedal to the neutral position. A control mechanism is coupled to the support and the pedal to retard pivotal movement of the pedal as the pedal returns from the operational positions to the neutral position.

According to another exemplary embodiment of the present disclosure, a bidirectional pedal assembly for a vehicle includes a support configured to be mounted on the vehicle, a pivot shaft disposed within the support, and a pedal pivotally coupled to support about the pivot shaft. The pedal pivots between a neutral position, a first operational position, and a second operational position. The second operational position is opposite the first operational position relative to the neutral position. A biasing member is mounted within the support and continuously biasing the pedal to the neutral position. A frictional mechanism is disposed within the support and provides increasing resistance to the pedal as the pedal moves increasingly away from the neutral position to one of the first operational position and the second operational position. A control mechanism is coupled to the support and the pedal to retard pivotal movement of the pedal as the pedal returns from the operational positions to the neutral position.

Another exemplary embodiment of the present disclosure provides a method of operating a bidirectional pedal assembly comprising a support mounted on a vehicle, a pivot shaft disposed within the support, a pedal pivotally coupled to the support about the pivot shaft, a handle operably coupled to the pedal, a biasing member mounted within the support, and a control mechanism coupled to the support and the pedal. One of the pedal and the handle is depressed to pivot both of the pedal and the handle in a first radial direction from a neutral position. The biasing member is biased as the pedal and the handle concurrently move away from the neutral position. The biasing member urges the pedal and the handle in a second radial direction opposite the first radial direction. The pedal or the handle is released by the operator to permit both of the pedal and the handle to pivot in the second radial direction under the influence of the biasing member. The movement of the pedal and the handle are retarded in both the first radial direction and the second radial direction with the control mechanism.

Accordingly, it is an object of the present disclosure to provide an improved bidirectional pedal assembly that returns to neutral position while preventing oscillation about or minimizing overshoot of the neutral position.

BRIEF DESCRIPTION OF THE DRAWINGS

The invention will be further described in the following description of the particular embodiments in connection with the drawings.

DETAILED DESCRIPTION OF THE DISCLOSURE

Figure 1:
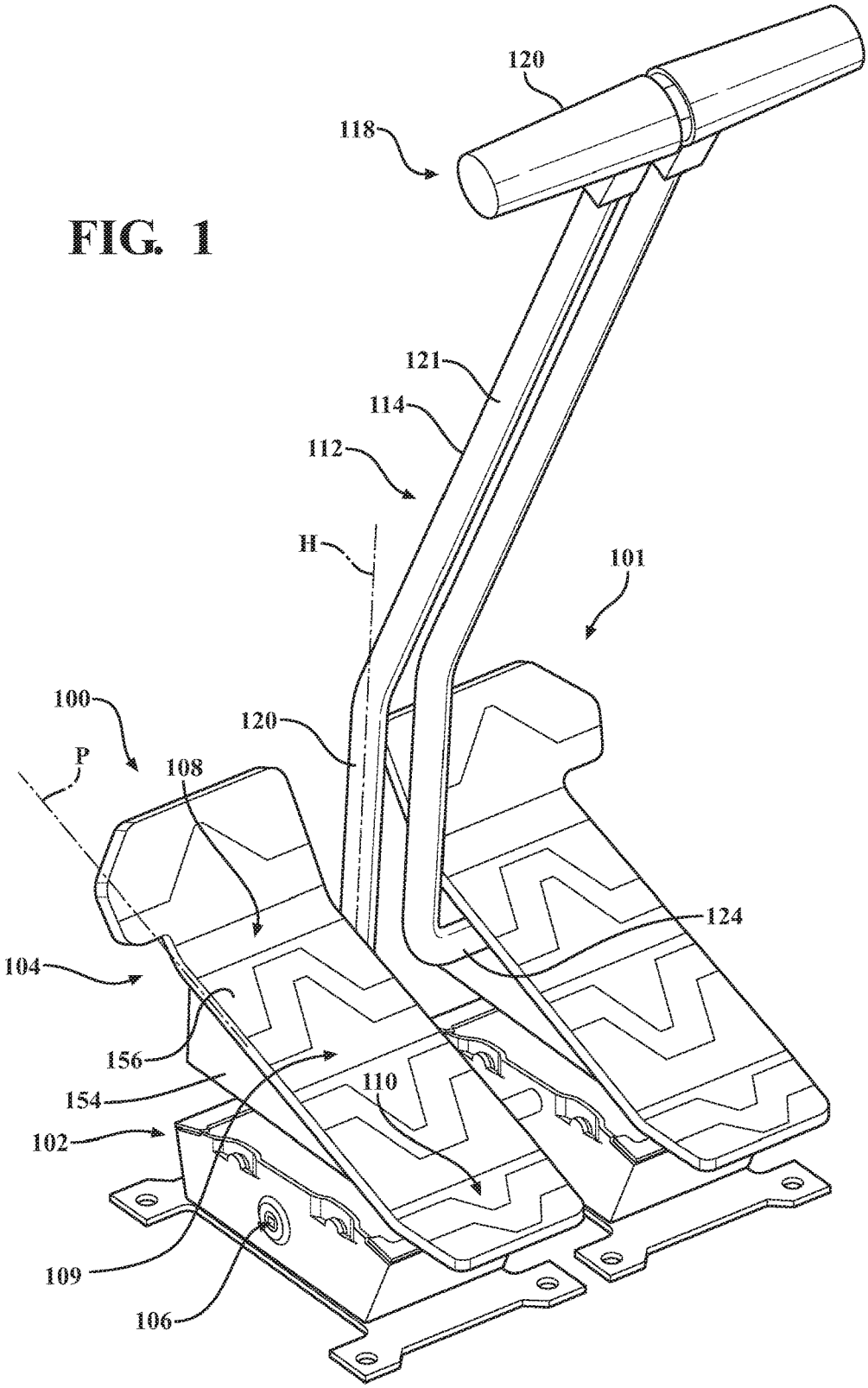
FIG. 1 illustrates a perspective view of a bidirectional pedal assembly according to an exemplary embodiment of the present disclosure.

Referring to FIG. 1, a pair of bidirectional pedal assemblies 100, 101 according to an exemplary embodiment is illustrated. FIG. 1 illustrates two bidirectional pedal assemblies 100, 101 positioned in a side-by-side configuration. In a preferred application, one bidirectional pedal assembly 100 controls one operation and/or component of a vehicle, while the other bidirectional pedal assembly 101 controls another operation and/or component of the vehicle. For example, with a continuous tracked tractor (e.g., bulldozer or other crawler), the left bidirectional pedal assembly 100 (from a perspective of an operator) can control the left track whereas the right bidirectional pedal assembly 101 can control the right track. Other wheeled heavy equipment machines such as a front loader can be similarly controlled by the left and right bidirectional pedal assemblies 100, 101, as disclosed herein, to provide for low turning radius or "zero turning radius." Other applications are also contemplated, such as one bidirectional pedal assembly 100 controlling the blade of a bulldozer, while the other bidirectional pedal assembly 101 controls the ripper of the same.

While embodiments disclosed herein illustrate two bidirectional pedal assemblies configured to operate in tandem, the present disclosure contemplates one, two, three or four or more bidirectional pedal assemblies may be incorporated into a vehicle. In other words, each bidirectional pedal assembly 100, 101 can operate as an independently functioning unit. In figures illustrating two bidirectional pedal assemblies (e.g., FIGS. 1, 4, 5, etc.), the structure and function of one bidirectional pedal assembly will be disclosed in greater detail, but the structure and function of the other bidirectional pedal assembly should be considered essentially the same.

Figure 2A:
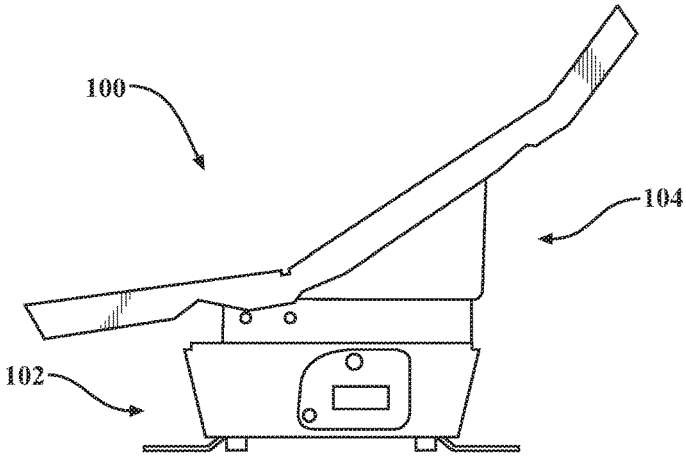
FIG. 2A illustrates a side elevation view of an exemplary bidirectional pedal assembly in a neutral position.
Figure 2B:
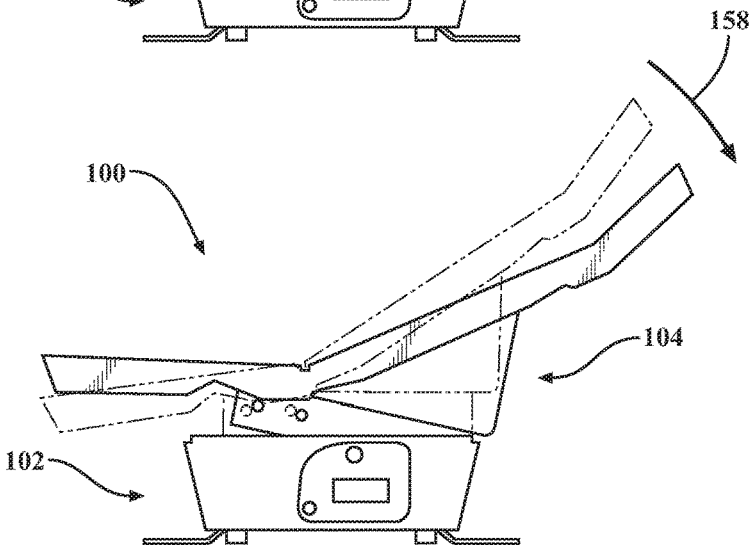
FIG. 2B illustrates a side elevation view of an exemplary bidirectional pedal assembly in a first operational position.
Figure 2C:
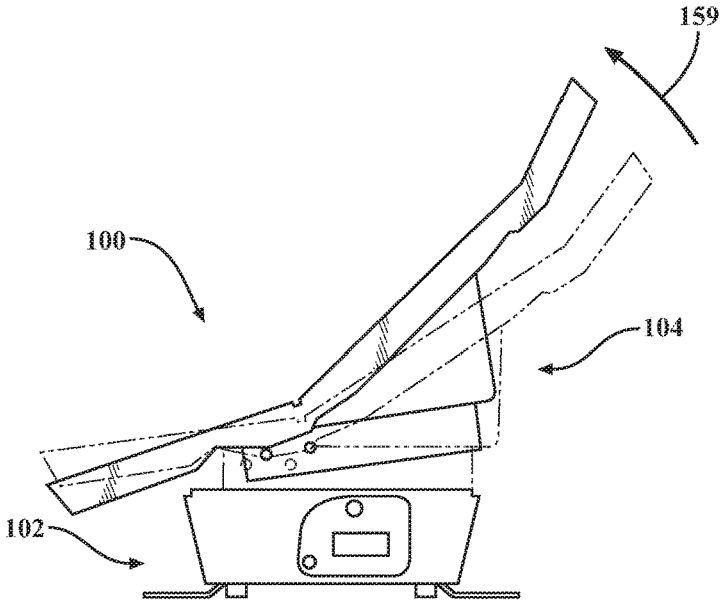
FIG. 2C illustrates a side elevation view of an exemplary bidirectional pedal assembly in a second operational position.

Returning to FIG. 1, the bidirectional pedal assembly 100 includes a support 102 configured to be mounted on a vehicle (not shown). A pedal 104 is pivotally coupled to the support 102 about a pivot shaft 106 disposed within the support 102. As illustrated in FIGS. 2A-2C, the pedal 104 is configured to pivot about the pivot shaft 106 between a first operational position and a second operational position opposite the first operational position relative to a neutral position. In a preferred embodiment, the pedal 104 is a treadle configured to receive input from a foot of the operator to move the treadle to one of the first operational position and the second operational position.

FIG. 2A illustrates the pedal 104 in the neutral position. In the neutral position, no input from the operator is being applied to the pedal 104. In general, in the neutral position, the foot of the operator is either not positioned on the pedal 104, or resting on the pedal 104 without sufficient force to overcome the components biasing the pedal 104 to the neutral position. In other words, the neutral position is a default configuration for the pedal 104 and the bidirectional pedal assembly 100 generally. Typically, in the neutral position, a sensor 138 (FIG. 4) associated with the bidirectional pedal assembly 100 is either not transmitting an active signal to a controller (not shown) associated with the vehicle, or transmitting a signal that the bidirectional pedal assembly 100 is in the neutral position. In short, when in the neutral position, the particular active operation of the vehicle under the control of the bidirectional pedal assembly 100 will not occur until the bidirectional pedal assembly 100 is actuated to one of the first operational position or the second operational position (i.e., the operational positions).

To move the pedal 104 to one of the operational positions, the operator applies a force, also referred to herein as a user input. It can be readily appreciated that in one aspect of the present disclosure, the user input can be by pivoting the pedal 104 with the foot of the operator. With continued reference to FIG. 1, the pedal 104 includes a first portion 108 and a second portion 110. In a general sense, the first portion 108 of the pedal 104 includes a portion of the pedal 104 on one side of the pivot shaft 106 (i.e., a vertical plane extending through the pivot shaft 106) such that application of the user input to the first portion 108 creates a torque about the pivot shaft 106 and thereby pivots the pedal 104 to the first operational position illustrated in FIG. 2B. Similarly, the second portion 110 of the pedal 104 includes a portion of the pedal 104 on the other side of the pivot shaft 106 (i.e., a vertical plane extending through the pivot shaft 106) such that application of the user input to the second portion 110 creates a torque about the pivot shaft 106 and thereby pivots the pedal 104 to the second operational position illustrated in FIG. 2C. An intermediate portion 109 is disposed between the first portion 108 and the second portion 110. In other words, the pivot shaft 106 is intermediate the first portion 108 and the second portion 110 of the pedal 104 and coupled to the intermediate portion 109. The first and second operational positions about the pivot shaft 106 intermediate the first portion 108 and the second portion 110 of the pedal 104 further characterize the bidirectional movement of the bidirectional pedal assembly 100. The opposing configuration of the first operational position and the second operational position classifies the pedal assembly as a bidirectional pedal assembly to those who are skilled in the art.

For purposes of the disclosure, the terms "first operational position" and "second operational position" include any degree of pivoting in the directions of the first operational position and second operational position, respectively, from the neutral position. In other words, this may include fully depressing the pedal 104 to a terminus or maximum, or depressing the pedal 104 by any lesser amount to pivot the pedal 104 from the neutral position.

As illustrated in the exemplary embodiment of FIG. 1, the pedal 104 includes a pedal surface 156 (FIGS. 1 and 3) oriented at an angle relative to horizontal. Doing so can advantageously provide for ease of operation and increased comfort for the operator. In particular, the first portion 108 is elevated relative to the second portion 110 such that application of a user input in a generally horizontal direction can provide the needed torque to pivot the pedal 104 from the neutral position to the first operational position. The configuration does not require the operator to hyperextend the ankle joint. Because the second portion 110 is positioned closer to the operator relative the first portion 108, application of a user input in a generally vertical direction can be made without undue difficulty.

Figure 4:
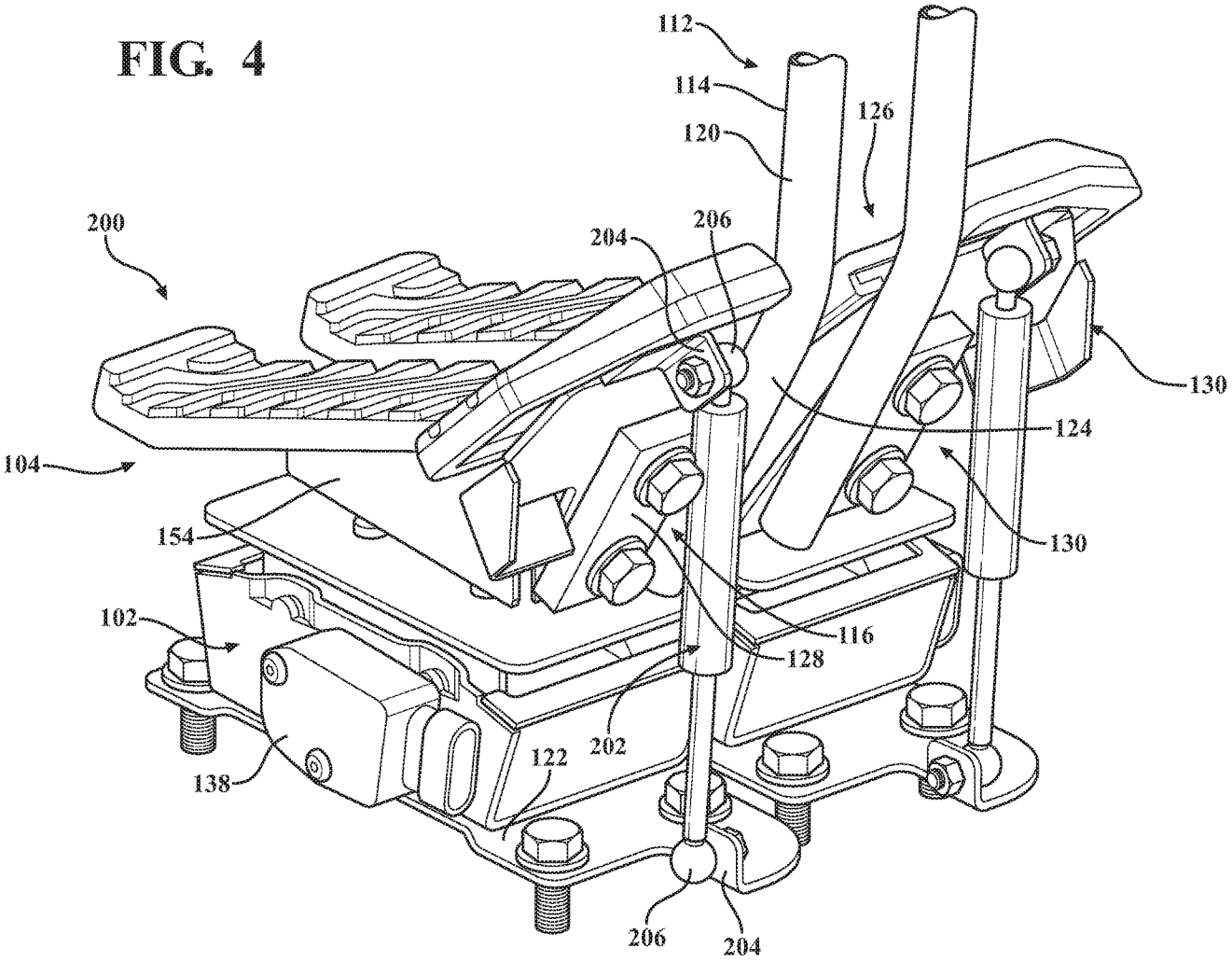
FIG. 4 illustrates a partial perspective view of a bidirectional pedal assembly according to an exemplary embodiment of the present disclosure.

According to at least some aspects of the present disclosure, the user input can be through pivoting a handle 112 with the hand and arm of the operator. With reference to FIGS. 1 and 4, the bidirectional pedal assembly 100 includes the handle 112 operably coupled to the pedal 104. In a preferred embodiment, the handle 112 is configured to pivot concurrently with the pedal 104. In other words, each of the pedal 104 and the handle 112 are configured to receive a user input. Upon the user input to either the pedal 104 and/or the handle 112, both the pedal 104 and the handle 112 pivot. Among other advantages, the configuration provides alternatives for the operator to prevent fatigue, accommodate individuals with a physical disability, and the like.

Furthermore, the present disclosure contemplates the pedal 104 and the handle 112 can pivot by the substantially same magnitude. The handle 112 has an initial position that corresponds to the pedal 104 in the neutral position. As the pedal 104 pivots to one of the operational positions, the handle 112 will likewise pivot. FIG. 1 illustrates an axis extending through a straight section of the handle 112 (e.g., Axis 'H' in FIG. 1), and an axis extending through a straight section of the pedal 104 (e.g., Axis 'P' in FIG. 1). The angular displacement of Axis H of the handle 112 from the initial position can be substantially equal to the angular displacement of Axis P of the pedal 104 from the neutral position. Among other advantages, the coordinated movement of the pedal 104 and the handle 112 can provide the operator with a predicted response of the vehicle operations based on actuation of either the pedal 104 and/or the handle 112.

The handle 112 can include an elongated member 114 having a first end 116 (FIG. 4) and a second end 118 opposite the first end 116. The elongated member 114 can be straight, comprised of straight sections, curvilinear, unitary, segmented, or of any other suitable construction and configuration to provide an accessible and ergonomic handle for the operator. In the illustrated embodiment of FIG. 1, the elongated member 114 has a vertical section 120 intermediate an angled section 121 extending vertically and towards the operator and a connecting section 124 disposed at approximately a ninety degree angle relative to the vertical section 120. In the illustrated embodiment of FIG. 4, the vertical section 120 and the connecting section 124 generally form a curvilinear elongated member 114.

The first end 116 of the elongated member 114 can directed connected to the pedal 104, as illustrated in FIG. 4, or operably coupled to the pedal 104 via a linkage 900 (FIGS. 16-22). Other configurations are also contemplated, including but not limited to coupling the first end 116 to any other suitable structure of the bidirectional pedal assembly 100 configured to pivot relative to the support 102. In certain aspects of the present disclosure, the first end 116 is rigidly connected to the pedal 104, and more particularly, at or proximate to the first portion 108 of the pedal 104. With continued reference to FIG. 1, the vertical section 120 is adjacent a side of the pedal 104, and bends at approximately ninety degrees to rigidly connect the connecting section 124 to the pedal 104. In the exemplary embodiment illustrated in FIG. 4, the vertical section 120 passes through a square-shaped chamfer 126, after which the connecting section 124 is rigidly connected to the pedal 104 with a mounting bracket 128. In the latter embodiment, the elongated member 114 extending through the chamfer 126 can advantageously permit two adjacent bidirectional pedal assemblies 100, 101 to be positioned closer together relative to the exemplary embodiment illustrated in FIG. 1. In both of the exemplary embodiments of FIGS. 1 and 4, the connecting section 124 of the elongated member 114 is connected to an underside 130 of the pedal 104. Based on the angled orientation of the pedal 104, as previously disclosed herein, ample clearance exists for such a connection on the underside 130 of the first portion 108 of the pedal 104. The present disclosure contemplates that any suitable connection point on the pedal 104 for the handle 112 can be used.

As mentioned, the elongated member 114 includes a second end 118. The second end 118 can include a grip 120. The grip 120 can be a discrete structure operably coupled to the elongated member 114 at the second end 118, or alternatively, the grip 120 can comprise a portion of the elongated member 114 at proximate the second end 118. An exemplary embodiment of the grip 120 is illustrated in FIG. 1, but other variations can include a knob, an arm, a loop, an ear, and the like.

Figure 3:
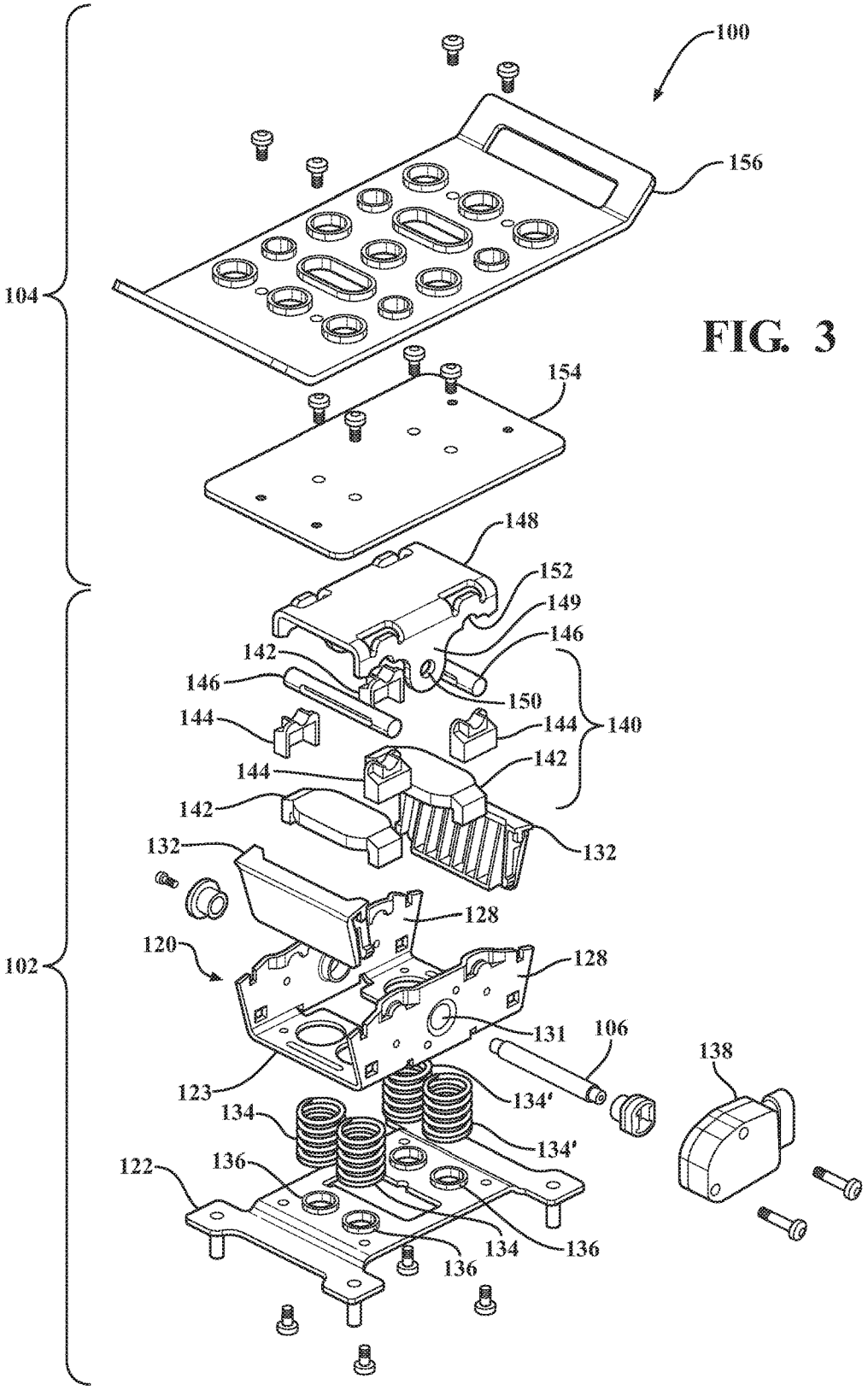
FIG. 3 illustrates an exploded view of a bidirectional pedal assembly according to an exemplary embodiment of the present disclosure.

FIG. 3 illustrates an exploded view of a bidirectional pedal assembly 100 in accordance with an exemplary embodiment of the present disclosure. In many respects, the structure and function of the bidirectional pedal assembly 100 is similar to that disclosed in commonly owned WO Publication No. 2014/0170126 filed on Apr. 1, 2014, which is herein incorporated by reference in its entirety. WO Publication No. 2014/0170126 is directed to a bidirectional pedal assembly with a hysteresis mechanism configured to provide feedback to an operator by generating friction between the pedal assembly and the fixed base. Any disclosure regarding the operation of the bidirectional pedal assembly of WO Publication No. 2014/0170126 considered to be abbreviated in the present disclosure is not to be construed as limiting to the incorporated reference.

The support 102 can comprise a mounting plate 122 adapted to be mounted on a fixed structure of the vehicle. A base 123 of a housing bracket 126 can be connected to the mounting plate 122 via screws, as illustrated in FIG. 3, or other fastening means commonly known in the art. The mounting plate 122 and the housing bracket 126 may be integrally formed. The housing bracket 126 can comprise opposing sidewalls 128 each including an aperture 130 through which the pivot shaft 106 is operably coupled. The housing bracket 126 can further comprise opposing end walls 132 adapted to be inserted and secured to the opposing sidewalls 128. In the exemplary embodiment illustrated in FIG. 3, the end walls 132 have a detent configured to create an interference fit with counterposing slots on the sidewalls 128.

One or more biasing members 134, 134' are mounted within the support 102. More particularly, the biasing members 134, 134' are situated on a boss 136 of the mounting plate 122. In other words, the biasing members 134, 134' are positioned within a cavity created by the assembly comprising the housing bracket 126 and the end walls 132. In a preferred embodiment, the biasing members 134, 134' comprise a first spring element 134 and a second spring element 134' with the pivot shaft 106 positioned intermediately thereto. In one exemplary embodiment, each of the first spring element 134 and the second spring element 134' comprise a pair of coil springs.

The sensor 138 can be operably coupled to the pivot shaft 106. The sensor 138 rotates with the pivot shaft 106. The sensor 138 is configured to provide a signal indicative of the angular position of the shaft 106 with respect to the support 102. An exemplary sensor includes those sensitive to magnetic flux—magnet elements within the support sensitive to magnetic flux provide a signal indicative of the rotational position of the pivot shaft 106 and thus of the pedal 104 with respect to the support 102. Other exemplary sensors are also contemplated, including but not limited to electromechanical sensors, optical sensors, and the like. One particular exemplary sensor is disclosed in European Patent No. 1857909, which is herein incorporated by reference in its entirety.

A frictional mechanism 140 can be disposed within the support 102. The frictional mechanism 140 is configured to provide increasing resistance to the pedal 104 as the pedal 104 moves increasingly away from the neutral position to one of the operational positions. Reference is again made to WO Publication No. 2014/0170126 for detailed structural and functional characteristics of an exemplary frictional mechanism 140.

In short, the frictional mechanism 140 comprises a spring perch 142 configured to rest upon the biasing member 134. The spring perch 142 can have a recess (not shown) within an underside adapted to situate the spring perch 142 upon the biasing member 134. A slider block 144 is positioned in abutment with the spring perch 142. The exemplary embodiment of FIG. 3 includes a pair of slider blocks 144 associated with each spring perch 142. Due to the inclined surfaces on both the spring perch 142 and the slider block 144, the slider block 144 is urged outwardly and effectively squeezed between the slider block 144 and one of the sidewalls 128 of the housing bracket 126 when the pedal 104 moves from the neutral position to one of the operational positions. Depressing the pedal 104 to one of the operational positions compresses an up stop pin 146 operably coupled to the slider block 144, which causes the slider block 144 to slidably engage the spring perch 142. Based on the design of the inclined surfaces both the spring perch 142 and the slider block 144, the resistive or retarding force generated by the frictional mechanism 140 in a direction opposite the motion increases as the pedal 104 continues to pivot from the neutral position to one of the operational positions. In other words, the greater angular displacement of the pedal 104 from the neutral position results in a greater resistive or retarding force from the frictional mechanism 140. The frictional mechanism 140 in the disclosed configuration defines a hysteresis system of the bidirectional pedal assembly 100 in accordance with an exemplary embodiment of the present disclosure.

A pivot bracket 148 is pivotally mounted within the support 102. More particularly, the pivot bracket 148 has opposing flanges 149 having apertures 150 configured to align with the apertures 130 disposed on the opposing sidewalls 128 of the housing bracket 126. The pivot shaft 106 extends through the apertures 130 of the housing bracket 126 and the apertures 150 of the pivot bracket 148, thereby permitting the pivot bracket 148 to pivot relative to the housing bracket 126. In certain aspects of the present disclosure, the pivot bracket 148 comprises a component of the support 102. In other aspects of the present disclosure, the pivot bracket 148 comprises a component of the pedal 104. Regardless, the pivot bracket 148 operably and pivotally couples the pedal 104 receiving the user input and the support 102 mounted to the vehicle.

The pivot bracket 148 further includes recesses 152 positioned on each side of the aperture 150. Consequently, the recesses 152 are positioned on each side of the pivot shaft 106 when the pivot bracket 148 is mounted within the support 102. In the exemplary embodiment illustrated in FIG. 3, the recesses 152 are semicircular in shape and configured to be situated atop the cylindrical up stop pin 146. Upon user input to the pivot bracket 148 (via the pedal 104), the recess 152 transfers a compressive force to the up stop pin 146, which is operably coupled to the slider block 144 of the frictional mechanism 140, as previously disclosed herein.

With continued reference to FIG. 3, a pedal bracket 154 is operably coupled to the pivot bracket 148, and a pedal surface 156 is operably coupled to the pedal bracket 154. The pedal bracket 154 can be connected to the pivot bracket 148 via screws, as illustrated in FIG. 3, or other fastening means commonly known in the art. The pedal bracket 154 and the pivot bracket 148 may be integrally formed. In certain aspects of the present disclosure, the pedal bracket 154 is a plate similar to the exemplary embodiment illustrated in FIG. 3. In such an embodiment, the pedal surface 156 can be oriented substantially horizontal. In other aspects of the present disclosure, the pedal bracket 154 is generally L-shaped so as to orient the pedal surface 156 at any desired angle relative to horizontal, as previously disclosed herein. The pedal bracket 154 and the pedal surface 156 can comprise a generally triangular configuration. Exemplary pedal brackets 154 are illustrated in FIGS. 1, 2A-2C, 4 and 5. Furthermore, removably securing the pedal bracket 154 and/or pedal surface 156 to the assembly can provide for retrofitting as well as modularity for service, replacement, customization, and the like.

With reference to FIGS. 1 and 3, an exemplary operation of the bidirectional pedal assembly 100 is described. As mentioned, without the influence of external forces, the pedal 104 is in the neutral position illustrated in FIG. 2A. Upon a user input to, for example, the first portion 108 of the pedal 104 (or to the handle 112, if applicable), the pedal 104 will pivot in a first radial direction of arrow 158 (FIG. 2B) to the first operating position illustrated in FIG. 2B. As the pedal 104 pivots from the neutral position, the biasing member 134 disposed on a corresponding side of the pivot shaft 106 will be biased. Concurrently, the frictional mechanism 140 provides an increasing resistive or retarding force to the pedal 104 in a second radial direction of arrow 159 (FIG. 2C) as the pedal 104 moves increasingly away from the neutral position to the first operational position, as previously disclosed herein. Once in the first operational position, the sensor 138 generates a signal indicative of the same, and the associated operation(s) of the vehicle are controlled accordingly.

Those skilled in the art appreciate that a biasing member stretched or compressed by a force will oscillate after the force is released. The biasing member will continue to oscillate unless a counteracting force acts on the oscillating motion. Thus, upon release of the user input, the biased biasing member 134 urges the pedal 104 in the second radial direction 159 towards the neutral position. The pedal 104 and the handle 112 obviously have mass; by way of example only, an aluminum pedal, a steel pivot bracket and fasteners can have a mass of approximately one kilogram, a handle can have a mass of one kilogram, and a pedal bracket can have a mass of 0.4 kilograms. The mass of the pivoting assembly moving at a given speed will be associated with an inertia that urges it to pass through the neutral position into a second operational position.

Yet as the pedal 104 moves into the second operational position, the biasing member 134 on the opposite side of the pivot shaft 106 urges the pedal 104 in the first radial direction 158 towards the neutral position. In such a configuration, the biasing members 134 are continuously biasing the pedal 104 to the neutral position. In exemplary embodiments using coiled springs, overshoot can again occur based on the spring constants of the biasing members 134 relative to the inertia of the pedal 104 and handle 112. In short, the system acts as an underdamped harmonic oscillator with component friction as the only damping mechanism.

The angular displacement of the pedal 104 past the neutral position (upon returning to the same) defines "overshoot" and is undesirable in an electronically controlled vehicle, as previously disclosed herein. In particular, as the pedal 104 moves into the second operational position against the intention of the operator, the sensor 138 generates a signal indicative of the same, which could cause rapidly changing signals to the system (e.g., brakes, engine, etc.).

To minimize such overshoot, the bidirectional pedal assembly 100 of the present disclosure includes a control mechanism configured to retard pivotal movements of the pedal 104 as the pedal 104 returns from one of the operational positions to the neutral position. In another exemplary embodiment, the control mechanism retards pivotal movements of the pedal 104 and the handle 112 as the pedal 104 and the handle 112 return from one of the operational positions to the neutral position. In other words, the biasing member 134 and the control mechanism are configured to force the pedal 104 (and the handle 112, if applicable) to the neutral position with no overshoot within a predetermined period. In a preferred embodiment, the pedal 104 returns to the neutral position with no overshoot within 175 milliseconds. Other predetermined periods are also contemplated, including but not limited to less than 50, 100, 200, 300 and 400 milliseconds. Furthermore, the biasing member 134 and the control mechanism are configured to maintain the pedal 104 within a predetermined angular displacement during vibration testing. In a preferred embodiment, the pedal 104 remains within +/−0.75 degrees of the neutral position under a root mean square (rms) acceleration of 7.23 G. It is an object and advantage of the present disclosure to achieve a critically damped system to minimize overshoot and the time required to return the pedal 104 to the neutral position.

FIG. 4 illustrates a bidirectional pedal assembly 200 in accordance with an exemplary embodiment of the present disclosure. The bidirectional pedal assembly 200 includes the control mechanism 202 coupled to the support 102 and the pedal 104. More particularly, the control mechanism 202 is coupled to the mounting plate 122 of the support 102 and the underside 130 of the first portion 108 of the pedal 104. The present disclosure also contemplates other connecting locations for the control mechanism 202, such as proximate to the second portion 110 of the pedal 104. In the exemplary embodiment illustrated in FIG. 4, each of the pedal 104 and the mounting plate 122 can include an L-shaped coupling bracket 204. The control mechanism 104 comprises a linear damper or shock absorber mounted to the coupling brackets 204 with an L-shaped ball joint 206. Embodiments using a linear shock absorber can include pneumatics, hydraulics, or otherwise to retard pivotal movements of the pedal 104. The dampers have a damping rate that is proportional to the velocity of a movable member (e.g., a piston) relative to a housing. Thus, a magnitude of a retarding force is based, at least in part, on the rotational speed of the pedal 104 (and the handle 112, if applicable).

For example, if the pedal 104 (and the handle 112, if applicable) is pivoted to a maximum in either the first radial direction 158 or second radial direction 159, the biasing member 134 will be displaced to an operating maximum as well. Given that the force from a biasing member 134 is typically proportional to the distance displaced, the relatively higher force from the biasing member 134 results in a relatively higher rotational speed as the pedal 104 pivots in the opposite radial direction towards the neutral position. The control mechanism 202 retards the angular displacement with a force substantially proportional to the velocity of the pedal 104. Consequently, during a first pass of the pedal 104 through the neutral position, the pedal 104 will be pivoting at a relatively slower speed than in the absence of the control mechanism 202. The biasing members 134 on the opposite side of the pivot shaft 106 will be compressed less, and the process repeats until the cooperative effort of the biasing member 134 and the control mechanism 202 force the pedal 104 to the neutral position in relatively less time than would be required by an underdamped system.

Figure 5:
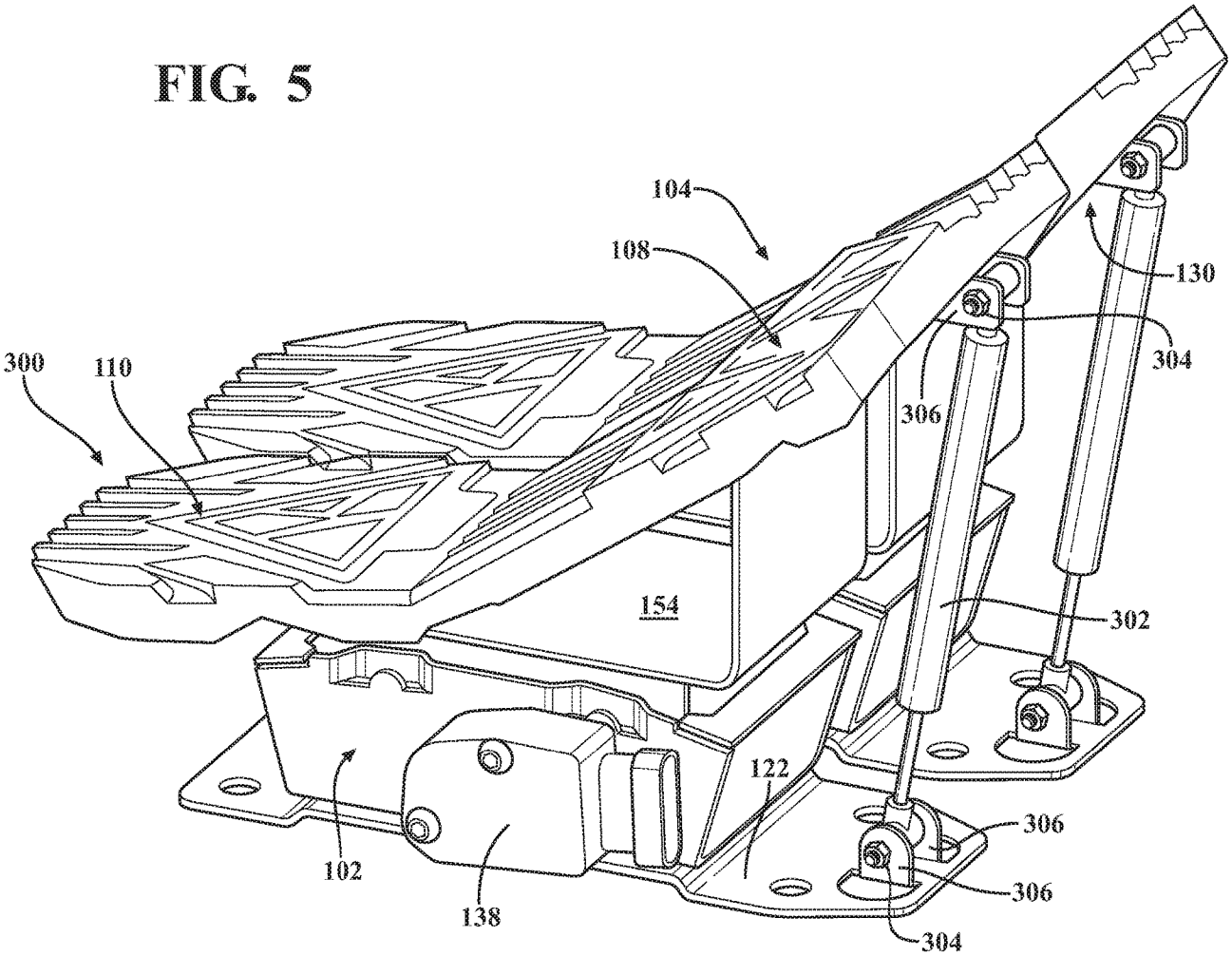
FIG. 5 illustrates a perspective view of a bidirectional pedal assembly according to an exemplary embodiment of the present disclosure.

Referring to FIG. 5, a bidirectional pedal assembly 300 in accordance with another exemplary embodiment of the present disclosure is illustrated. In many respects, the bidirectional pedal assembly 300 is similar to the bidirectional pedal assembly 200 of FIG. 4. The bidirectional pedal assembly 300 of FIG. 5 includes a control mechanism 302 comprising a linear damper or shock absorber coupled to the mounting plate 122 of the support 102 and the underside 130 of the first portion 108 of the pedal 104. The control mechanism 302 of FIG. 5 incorporates a through-bolt 304 connecting to flanges 306 extending outwardly from the mounting plate 122 and/or the pedal 104. In addition to the embodiments illustrated in FIGS. 4 and 5, the present disclosure contemplates the control mechanism 202, 302 can be mounted by a clevis pin, or any other suitable coupling device commonly known in the art. Further, the bidirectional pedal assembly 300 of FIG. 5 does not include handles. A control mechanism can be incorporated into a bidirectional pedal assembly with or without handles without deviating from the objects of the present disclosure; i.e., disclosure directed to movement of the pedal 104 should also be construed as directed to the pedal 104 and handle 112.

Figure 6A:
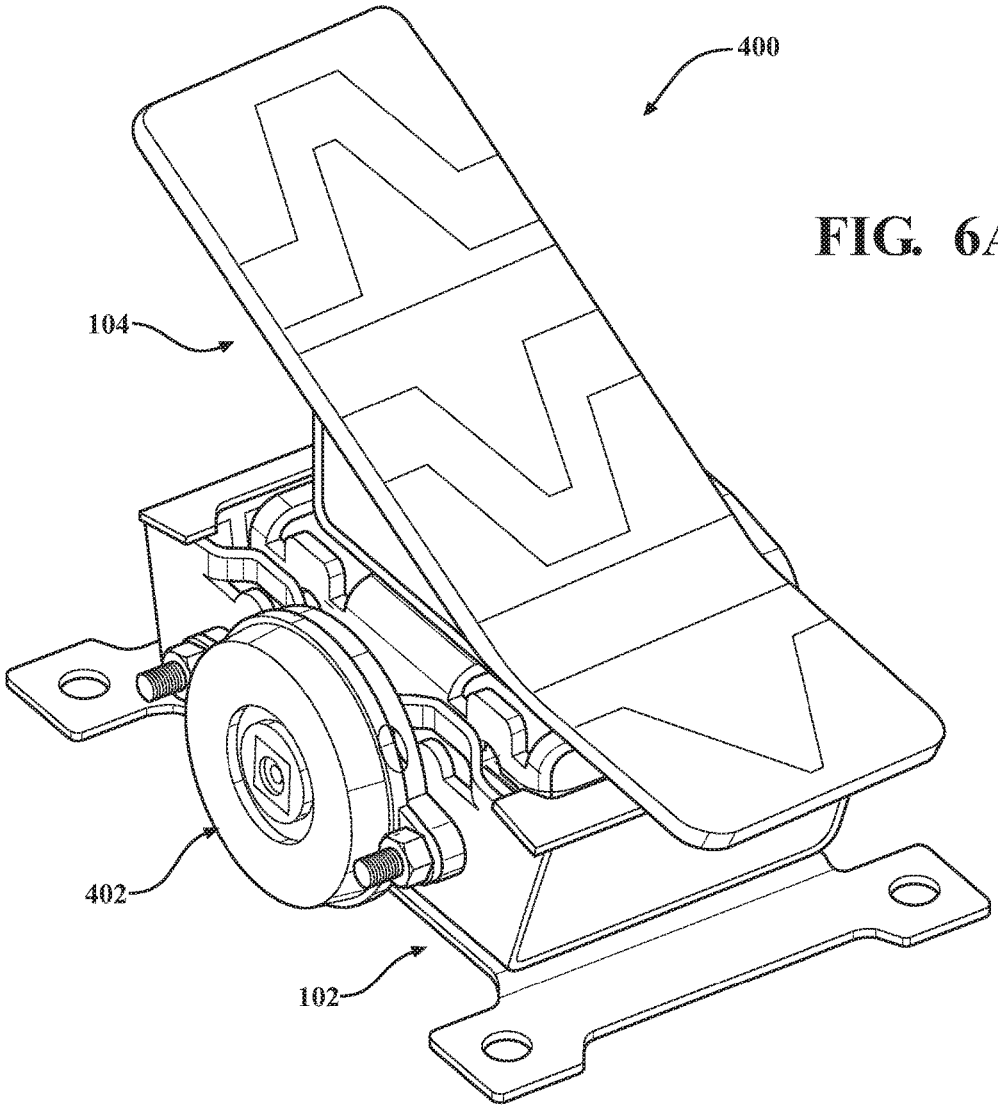
FIG. 6A illustrates a perspective view of a bidirectional pedal assembly according to an exemplary embodiment of the present disclosure.
Figure 6B:
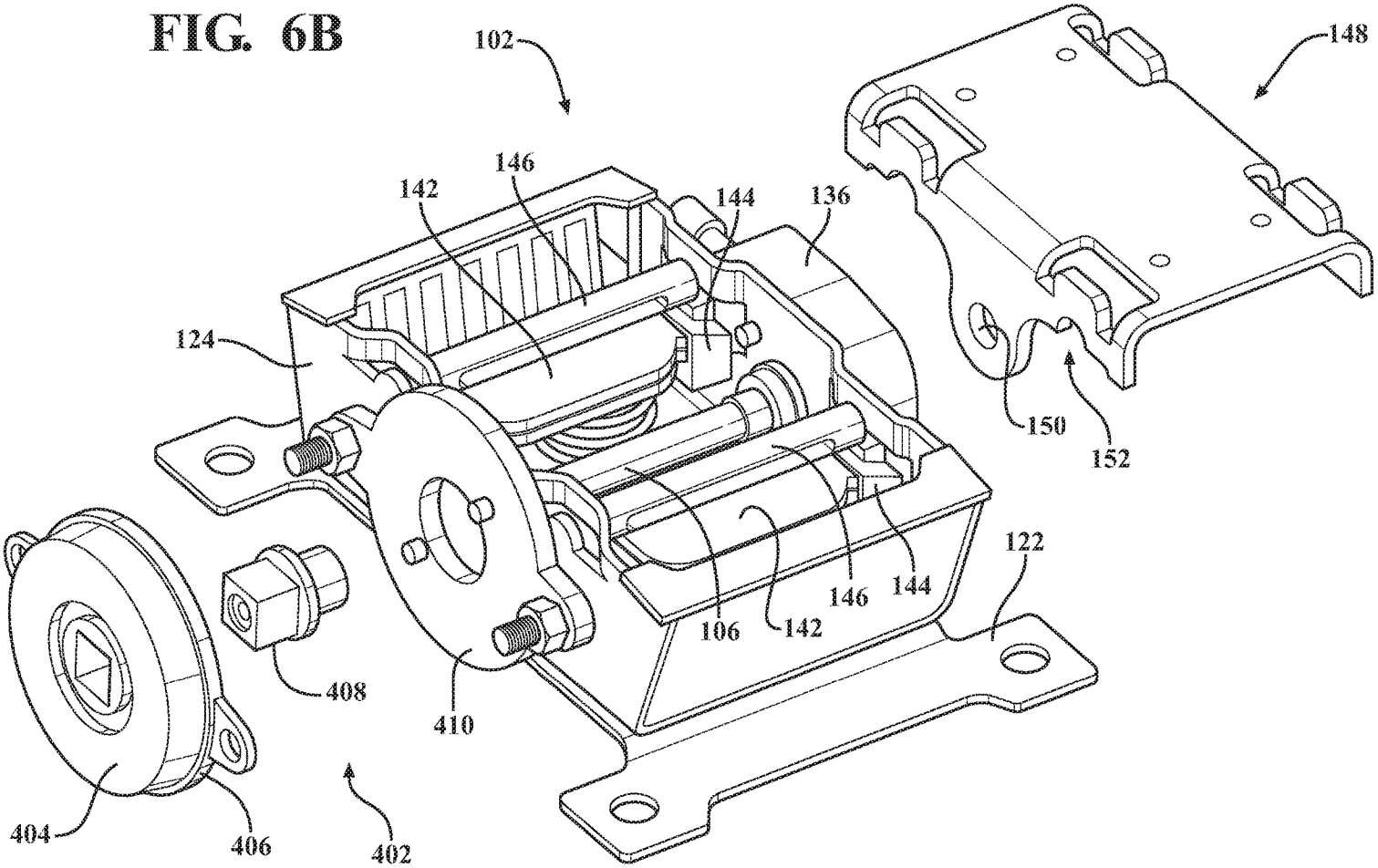
FIG. 6B illustrates a perspective view of a support of a bidirectional pedal assembly according to an exemplary embodiment of the present disclosure. A pivot bracket and a control mechanism are shown as exploded from the support.
Figure 7:
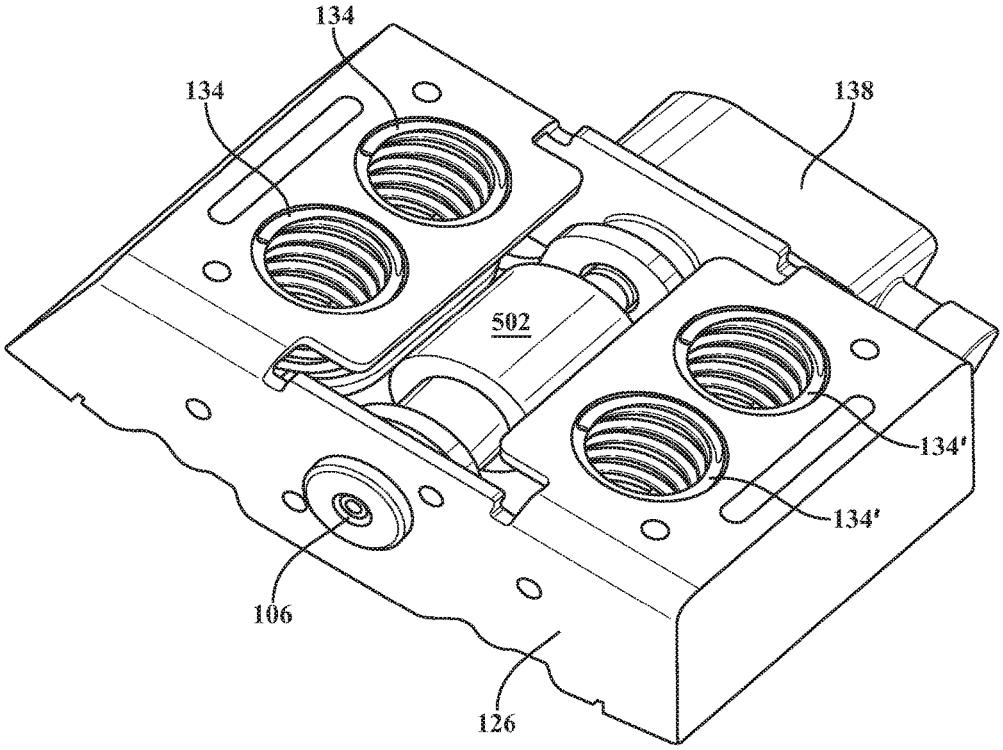
FIG. 7 illustrates a partial perspective view of a support of a bidirectional pedal assembly according to an exemplary embodiment of the present disclosure.

According to another exemplary embodiment of the present disclosure, the control mechanism can comprise a rotary damper as illustrated in FIGS. 6A, 6B and 7. Referring first to FIGS. 6A and 6B, the bidirectional pedal assembly 400 includes the control mechanism 402 operably coupled to the support 102 and to the pedal 104 via the pivot shaft 106. The rotary damper can include two sections 404, 406 that are rotatable relative to one another. The first section 404 is coupled to a rotating component such as the pivot shaft 106 via a shaft coupler 408, whereas the second section 406 is coupled to a fixed portion of the support 102. In the exemplary embodiment illustrated in FIGS. 6A and 6B, the second section 406 is coupled to the support 102 via an intermediary bracket 410 rigidly secured to the support 102. The rotary damper may include a silicone fluid between the two sections with the silicone fluid limiting movement between the two sections which imparts the damping properties to the pedal 104. Other contemplated dampers include variable damping rate damper, hydraulic fluid-based damper; magnetic rheostatic fluid dampers, shapers with a gas-charged spring, and the like.

The control mechanism 402 is bidirectional and imparts damping properties as the pedal 104 pivots in either of the two radial directions 158, 159. The operation of the control mechanism 402 as it relates to the bidirectional pedal assembly 400 is substantially similar to the embodiments previously disclosed herein. The exemplary embodiment of FIGS. 6A and 6B permit retrofitting of existing bidirectional pedal assemblies with an external control mechanism as well as ease of installation and/or repair should performance be compromised.

In the exemplary embodiment illustrated in FIG. 7, a bidirectional pedal assembly 500 includes a control mechanism 502 disposed within the support 102. More particularly, the control mechanism 502 can be a rotary damper operably coupled to the pivot shaft 106 and positioned intermediate the biasing members 134, 134' associated with each of the first operational position and the second operational position. Similar to the embodiment illustrated in FIGS. 6A and 6B, the control mechanism 502 can include a section coupled to the pivot shaft 106, and another section coupled to a fixed portion of the support 102. The operation of the control mechanisms 402 as it relates to the bidirectional pedal assembly 400 is substantially similar to the embodiments previously disclosed herein. Among other advantages, positioning the control mechanism 502 within the support 102 requires less space and prevents ingress of impediments that could detrimentally affect the performance of the control mechanism 502.

Figure 8:
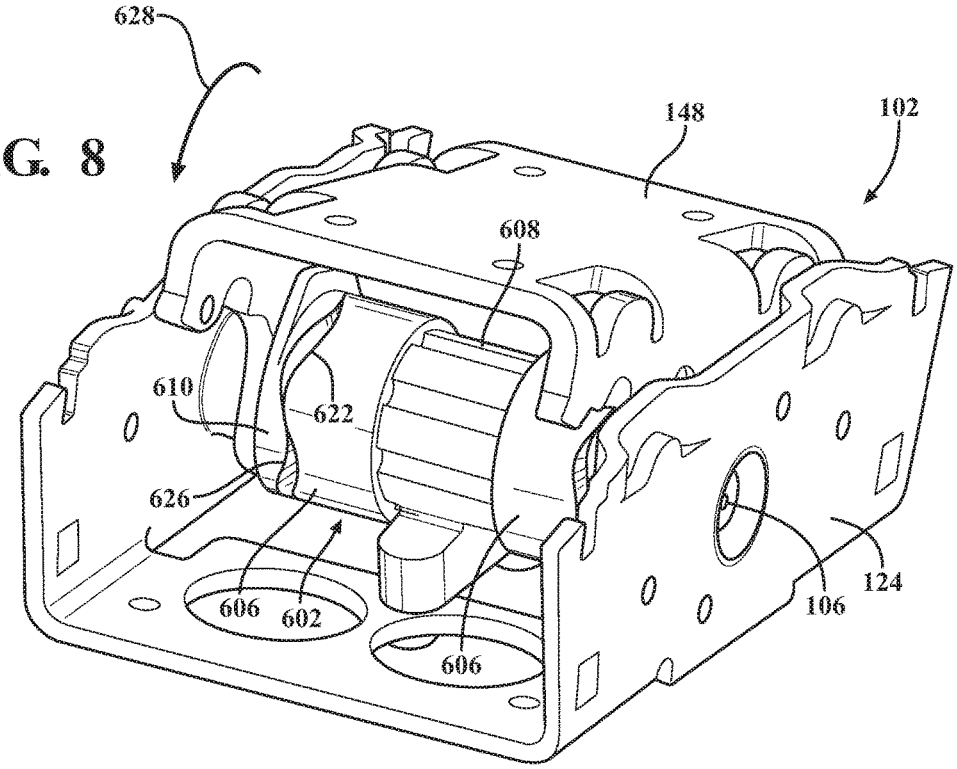
FIG. 8 illustrates a partial perspective view of a support of a bidirectional pedal assembly according to an exemplary embodiment of the present disclosure.
Figure 9:
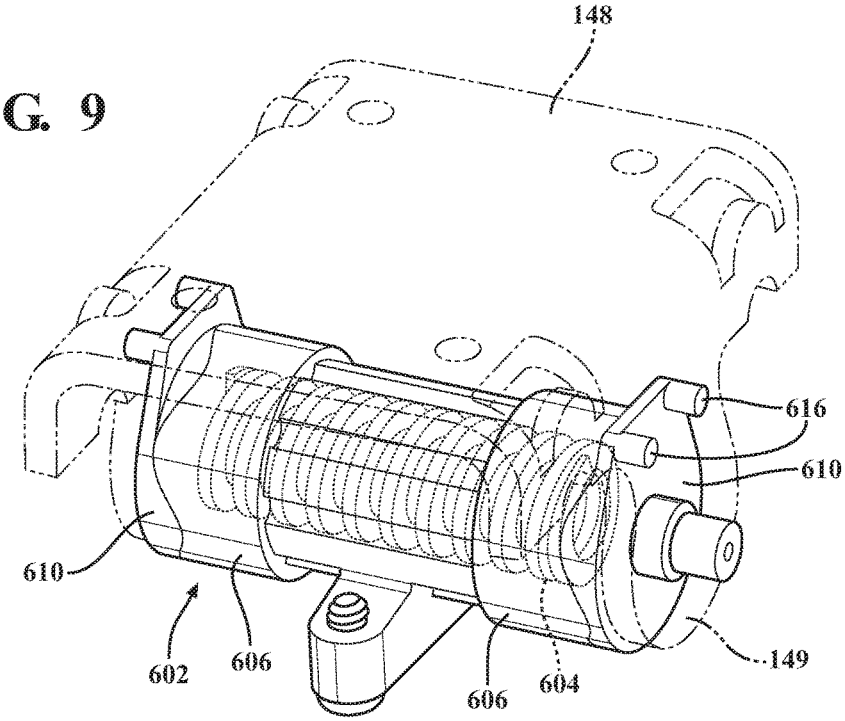
FIG. 9 illustrates a perspective view of a control mechanism according to an exemplary embodiment of the present disclosure. A pivot bracket is shown in phantom.

FIG. 8 illustrates another control mechanism 602 in accordance with another exemplary embodiment of the present disclosure. A portion of a support 102 is illustrated with several components removed for clarity. The control mechanism 602, also referred to as a center brake mechanism, is positioned within and coupled to the support 102, and coupled to the pedal 104 via the pivot shaft 106. As illustrated in FIGS. 8 and 9, the control mechanism 602 is generally coaxial with the pivot shaft 106.

Figure 10:
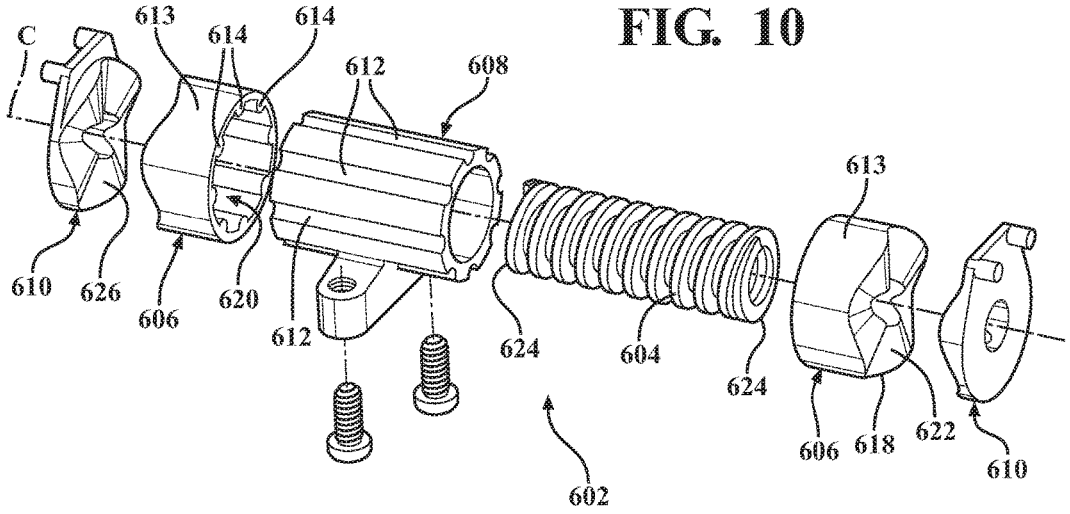
FIG. 10 illustrates an exploded view of the control mechanism of FIG. 9 according to an exemplary embodiment of the present disclosure.

The control mechanism 602 includes a transverse biasing member 604 disposed about the pivot shaft 106. In the exemplary embodiment illustrated in FIGS. 8-11, the transverse biasing member 604 is a coil spring, but other suitable biasing members are contemplated with out deviating from the objects of the present disclosure. A brake cup 606, a brake housing 608 and a brake plate 610 are also disposed about the pivot shaft 106. As illustrated in FIG. 10, the brake cup 606 and the brake housing 608 are radially fixed relative to one another. In the exemplary embodiment of FIG. 10, the brake housing 608 has grooves 612 extending axially along and disposed radially about an outer circumference of the brake housing 608. The brake cup 606 has counterposing protrusions 614 extending axially along and disposed radially about an inner circumference of an annular wall 613 of the brake cup 606. The protrusions 614 and the grooves 612 are configured to radially, but not axially, fix the brake cup 606 and the brake housing 608. In other words, with reference to FIG. 10, the brake cup 606 can slide axially along Axis C relative to the brake housing 608 based upon, at least in part, the influence of the transverse biasing member 604, which will be discussed in detail below. The brake housing 608 is mounted to the support 102 with a fastener, as illustrated in FIGS. 8-11, or though any other means commonly known in the art. The positioning of the brake housing 608 is radially and axially fixed relative to the support 102. Consequently, the brake cup 606 is radially fixed relative to the support 102.

Figure 11:
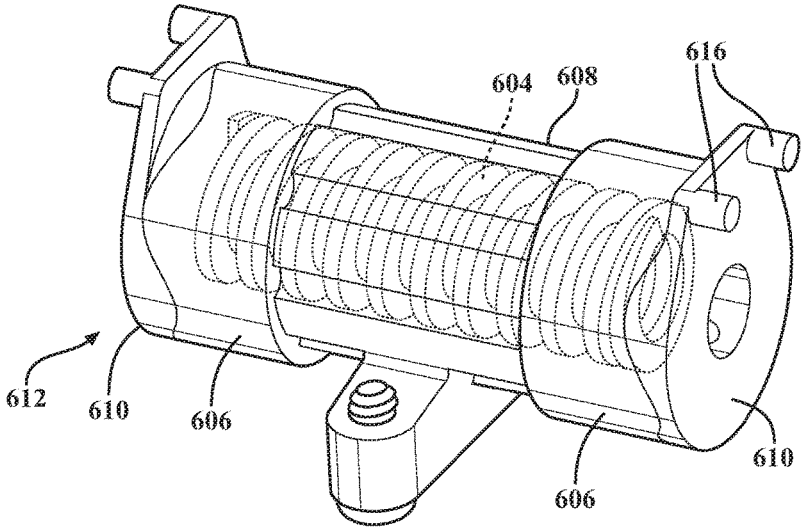
FIG. 11 a perspective view of the control mechanism of FIG. 9 according to an exemplary embodiment of the present disclosure.
Figure 12:
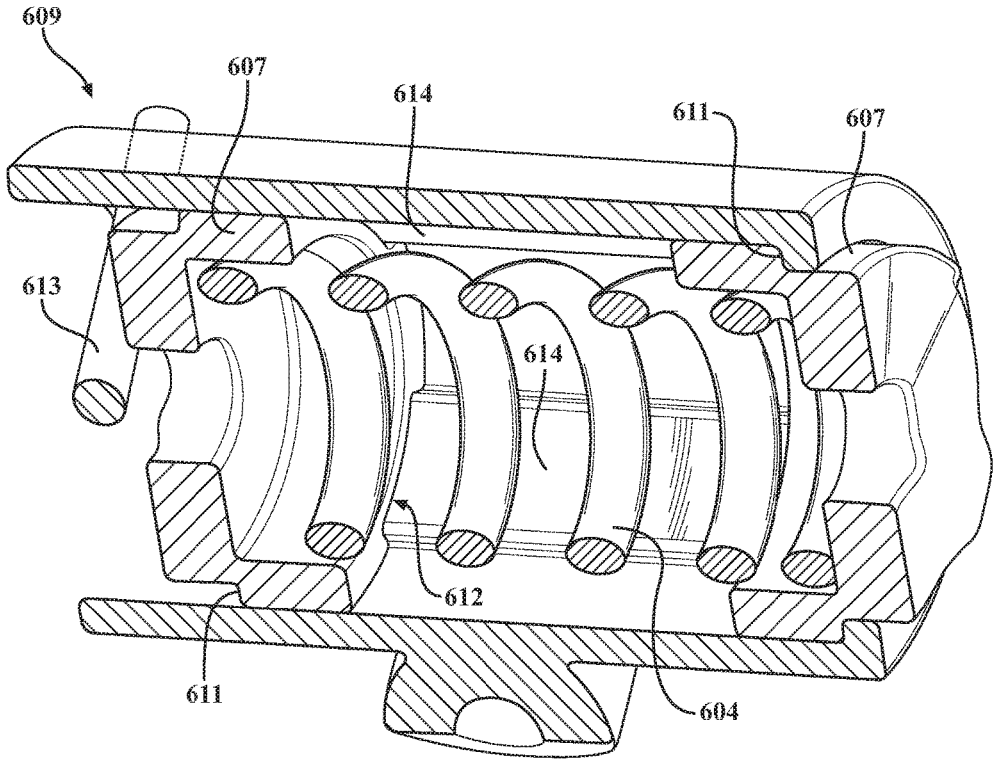
FIG. 12 illustrates a sectional view of a housing mount of a control mechanism according to an exemplary embodiment of the present disclosure.

Another exemplary embodiment of the brake cup 607 and brake housing 609 is illustrated in FIG. 12. Similar to the exemplary embodiment illustrated in FIGS. 8-11 each of the brake cup 607 and the brake housing 609 include grooves 612 and protrusions 614 to radially fix the structures relative to one another. Whereas the earlier disclosed embodiment included the brake cup 608 disposed on the outer diameter of the brake housing 608, FIG. 12 illustrates the brake cup 607 disposed on the inner diameter or within the brake housing 609. A transverse biasing member 604 is disposed within the brake housing 609 and about the pivot shaft 106 (not shown in FIG. 12). The transverse biasing member 604 urges the brake cup 607 axially outwardly. The exemplary embodiment of FIG. 12 includes counterposing flanges 611 associated with each of the brake cup 607 and the brake housing 609. The flanged surfaces 611 cooperatively define a maximum axial position of the brake cup 607 relative to the brake housing 609, as illustrated in the sectional view of FIG. 12. Among other advantages, having a maximum axial position of the brake cup 607 relative to the brake housing 609 assists with controlling the force applied by the brake cup 607 against the brake plate 610, as disclosed in detail below, ensuring undue force is not required to pivot the pedal 104 from the neutral position to one of the operational positions.

Because the brake cup 607 is disposed within the brake housing 609 and the flanged surfaces 611 define a maximum axial position, a stop member 613 is installed after the brake cup 607 is inserted. In FIG. 12, the stop member 613 is illustrated as a post through the annular wall of the brake housing 609, but any suitable structure can be used without deviating from the objects of the present disclosure provided it retains the brake cups 607 within the brake housing 609 against the biasing force of the transverse biasing member 604. The operation of the exemplary embodiment of FIG. 12 is similar to the exemplary embodiment of FIGS. 8-11 as disclosed herein.

Returning to FIGS. 8-11, the brake plate 610 is positioned adjacent the brake cup 606. More specifically, the brake plate 610 is positioned intermediate an in abutment with the brake cup 606 and the flange 149 of the pivot bracket 148. The brake plate 610 is radially fixed relative to the pivot bracket 148. The brake plate 610 has a pair of posts 616 configured to create an interference fit with holes (not shown) within the flange 149. As a result, the brake plate 610 pivots together with the pivot bracket 148 (and the pedal 104) upon the user input to the pedal 104.

Referring to FIG. 10, the brake cup 606 has a face 618 extending between the annular wall 613 of the brake cup 606. The annular wall 613 and the face 618 collectively define a cavity 620 and form a cup-like shape of the brake cup 606. Thus, the face 618 has an inner surface and an outer surface 622. The inner surface is a surface of the face 618 within the cavity 620 of the brake cup 606, whereas the outer surface 622 is a surface of the face 618 outside the cavity 620. In an assembled configuration illustrated in FIGS. 9 and 11, the transverse biasing member 604 has opposing ends 624 in abutment with the inner surface of the face 618. The length of the transverse biasing member 604 is adapted to be in a permanently biased state in the assembled configuration. As a result, the inner surface of the face 618 is continuously under the influence of a biasing force urging the brake cup 606 to axially slide relative the brake housing 608 such that the outer surface 622 of the face 618 is in direct contact with an inner surface 626 of the brake plate 610.

With further reference to FIG. 10, the outer surface 622 of the face 618 of the brake cup 606 is shaped to create a frictional and/or interference fit with an inner surface 626 of the brake plate 610. In the exemplary embodiment illustrated in FIGS. 8-11, the outer surface 622 and the inner surface 626 are counterposing surfaces having a sinusoidal shape. Alternative shapes are also contemplated by the present disclosure such as a sawtooth configuration or any other counterposing shapes that require axial displacement of the brake cup 606 in order for the counterposing surfaces 622, 626 to rotate relative to one another. The shape of the surfaces 622, 626 and the transverse biasing member 604 generally increase the load between the brake cup 606 and the brake plate 610 and further slows the assembly to rest and minimize overshooting the neutral position.

As mentioned, the brake cup 606 is radially fixed relative to the support 102 (via the brake housing 608), whereas the brake plate 610 is radially fixed relative to the pedal 104 (via the pivot bracket 148). Consequently, the outer surface 622 and the inner surface 626, which are held in direct contact by forces exerted by the transverse biasing member 604, are configured to rotate relative to one another. Based on the frictional and interferential effects of the shapes of the counterposing surfaces, a resistive or retarding force is generated as the pedal 104 is pivoted form the neutral position to one of the operational positions.

More specifically, FIG. 11 illustrates the control mechanism 602 when the pedal 104 is in the neutral position. In the exemplary embodiment having sinusoidal counterposing surfaces, a peak of one of the surfaces 622, 626 are aligned with the troughs of the other one of the surfaces 622, 626 when the pedal 104 is in the neutral position. Upon application of the user input to pivot the pedal 104, either via the pedal 104 or the handle 112, the brake plate 610, which is radially fixed relative to the pedal 104, must rotate relative to brake cup 606 radially fixed to the support 102. The counterposing surfaces require axial movement of the brake cup 606 in order for the relative rotation to occur. In the exemplary embodiment having sinusoidal counterposing surfaces, a peak of one of the surfaces 622, 626 is rotated closer to a peak of the other one of the surfaces 622, 626, which requires the brake cup 606 to move axially inwardly relative to the brake housing 604. Yet, the transverse biasing member 604 is opposing the axial motion urging the brake cup 606 outwardly, thereby creating a resistive or retarding force to the pivoting of the pedal 104 itself. In other words, the control mechanism 602 functions by creating friction and variable resistance force to the movement of the pedal 104. The interlocking geometric features of the brake plate 610 and the brake cup 606 interlock in such a way to create a resistance to movement from the neutral position.

In one of the operational positions, the support 102 appears similar to the exemplary embodiment illustrated in FIG. 8. More specifically, FIG. 8 illustrates that the peaks of the surfaces 622, 626 are not aligned with the troughs of the surfaces 622, 626. Upon release of the input force, the biasing member 134, which is continuously biasing the pedal 104 to the neutral position, supplies a force to pivot the pedal 104 in a radial direction of arrow 628 towards the neutral position. Additionally, the sinusoidal shape of the surfaces 622, 626, and the biasing force from the transverse biasing member 604, urge the peaks of the surfaces 622, 626 towards the troughs of the surfaces 622, 626 such that the pedal 104 pivots relative to the support 102. Once the counterposing surfaces 622, 626 are again aligned in the neutral position, overshoot will be minimized due to the forces required to achieve additional rotation.

The present disclosure contemplates that the shape of the counterposing surfaces 622, 626 are designed in a manner that as the pedal 104 is pivoted to a terminus or maximum, a peak for one of the surfaces 622, 626 cannot pass a peak of the other surface 622, 626. Preventing the peaks from passing one another ensures the control mechanism 602 is urging the pedal 104 towards the neutral position. Furthermore, those having skill in the art will appreciate that the damping characteristics of the center brake control mechanism 602 may be altered by the material used for the brake cups and the brake plates, the shapes of the brake cups and the brake plates, and the force supplied by the transverse spring.

Figure 13:
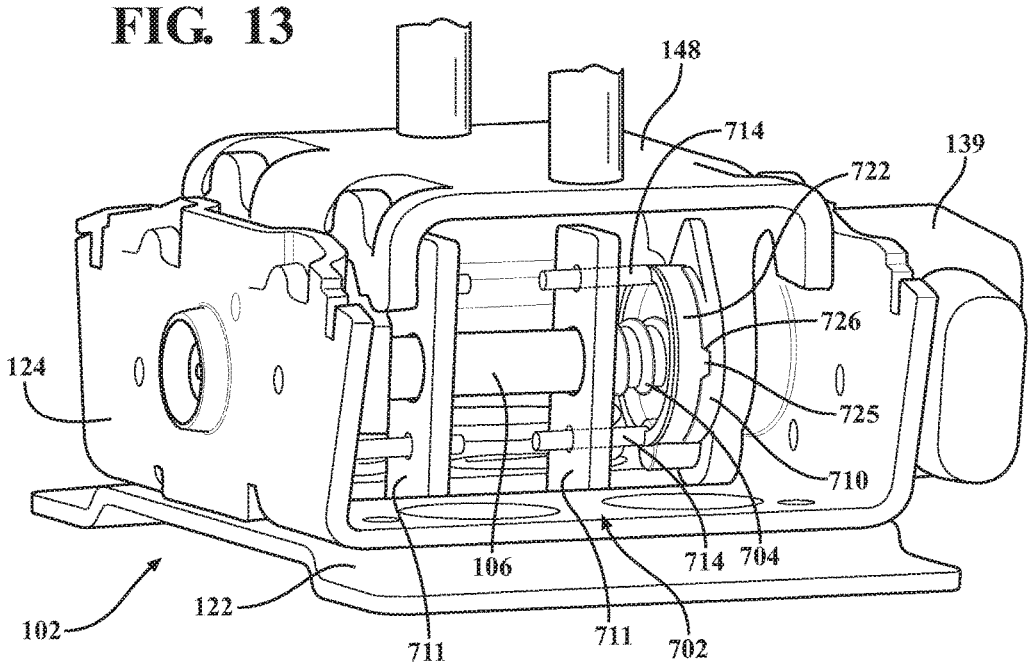
FIG. 13 illustrates a perspective view of a support of a bidirectional pedal assembly according to an exemplary embodiment of the present disclosure.

Referring to FIG. 13, a control mechanism 702 in accordance with another exemplary embodiment of the present disclosure is provided. The control mechanism 702 of FIG. 13 is similar in many respects to the control mechanism 602 of FIGS. 8-11. The control mechanism 702 illustrated in FIG. 13 comprises a transverse biasing member 704, a brake cup 706, and a brake plate 710, each of which functions in a manner similar to the exemplary embodiment illustrated in FIGS. 8-11. Whereas the earlier related embodiment required a brake housing 608 to radially fix the brake cup 606 to the support 102, the exemplary embodiment illustrated in FIG. 13 includes a stanchion 711 rigidly connected to the support 102. The stanchion 711 can be integral with or otherwise secured to the mounting plate 122 and/or the housing bracket 126 through means commonly known in the art. The stanchion 711 can have an aperture through which the pivot shaft 106 is installed. In the exemplary embodiment illustrated in FIG. 13, two stanchions 711 are included and are positioned in a vertical orientation.

The brake cup 706 includes posts 714 configured to create an interference fit with postholes extending through the stanchion 711. The interference fit radially fixes the brake cup 706 to the support 102, yet permits the brake cup 606 to slide coaxially to the pivot shaft 106 based upon, at least in part, the influence of the transverse biasing member 704.

Figure 14:
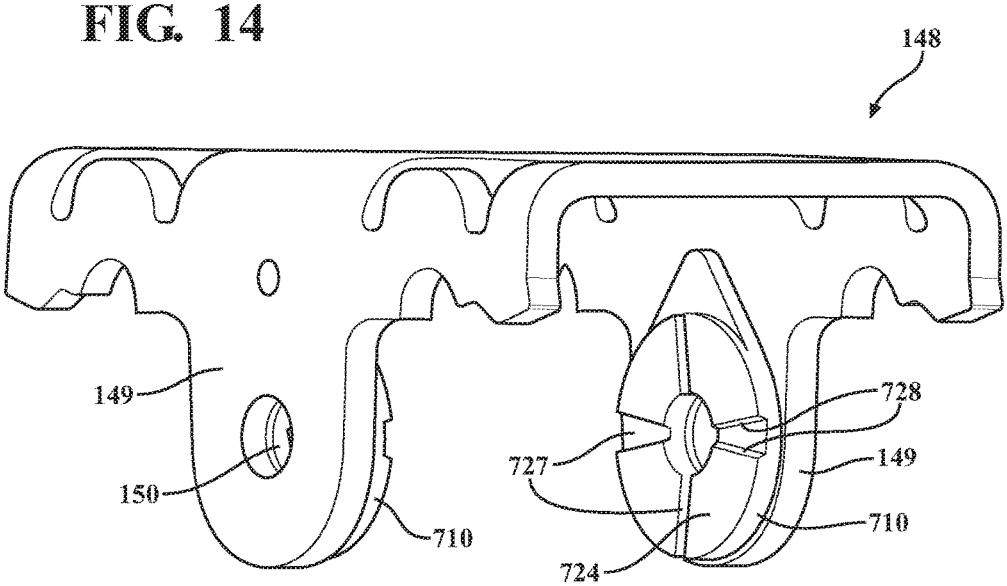
FIG. 14 illustrates a perspective view of a pivot bracket according to an exemplary embodiment of the present disclosure.

Whereas the exemplary embodiment of FIGS. 8-11 included sinusoidal surfaces comprised of an inner surface 626 of the brake plate 610 and an outer surface 622 of the brake cup 606, the brake plate 710 illustrated in FIGS. 13 and 14 comprises an inner surface 726 having a plurality of slots 727 radially spaced about the inner surface 726. FIG. 14 illustrates four slots 727, but any number of slots can be incorporated without deviating from the objects of the present disclosure. The slots 727 can include chamfered edges 728.

The outer surface 722 of the brake cup 706 can include a plurality of counterposing ridges 725 shaped to slidably engage the slots 727 of the brake plate 710, similar in many respects to the exemplary embodiment illustrated in FIGS. 8-11. The ridges 725 can also include chamfered edges 726 generally contoured to the chamfered edges 728 of the slots 727.

In the neutral position, the ridges 725 engages the slots 727 under the influence of the biasing force from the transverse biasing member 704. Upon application of the user input to pivot the pedal 104, via either the pedal 104 or the handle 112, the brake plate 710, which is radially fixed relative to the pedal 104, must rotate relative to brake cup 706 radially fixed to the support 102. The counterposing surfaces require axial movement of the brake cup 606 in order for the relative rotation to occur. Absent the matching chamfered edges 726, 728, the ridges 725 could not disengage from the slots 727 in order to permit the brake cup 706 to move axially (inwardly). Yet as the matching chamfered edges 726, 728 slidably disengage, a resistive or retarding force is generated as the pedal 104 is pivoted form the neutral position to one of the operational positions.

Upon release of the user input, the biasing member 134, which is continuously biasing the pedal 104 to the neutral position, supplies a force to pivot the pedal 104 in a radial direction of towards the neutral position. Once the matching chamfered edges 726, 728 begin to reengage, the biasing force from the transverse biasing member 604 urges the ridges 725 into the slots 727 such that the pedal 104 pivots to the neutral position. One the counterposing surfaces are again aligned in the neutral position, overshoot will be minimized due to the forces required to cause the ridges 725 and the slots 727 to re-disengage.

Figure 15A:
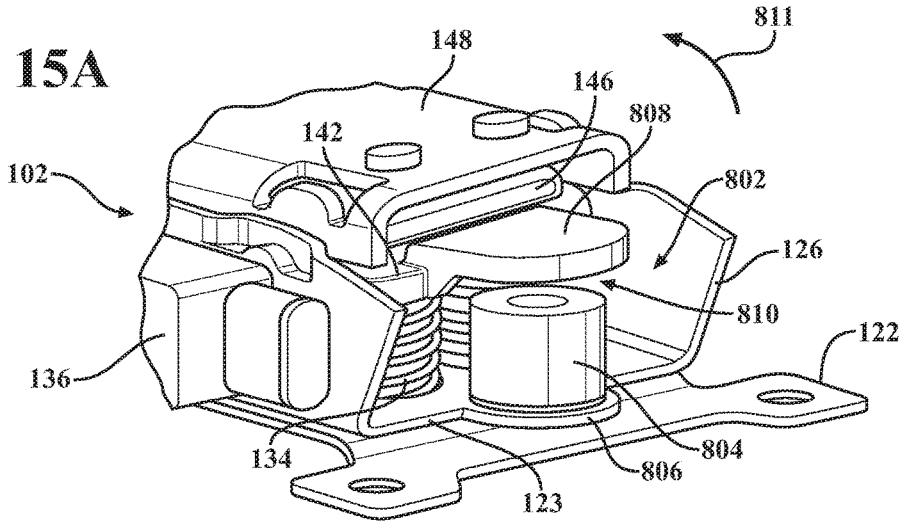
FIG. 15A illustrates a partial perspective view of a support with a control mechanism in a first operational position according to an exemplary embodiment of the present disclosure.
Figure 15B:
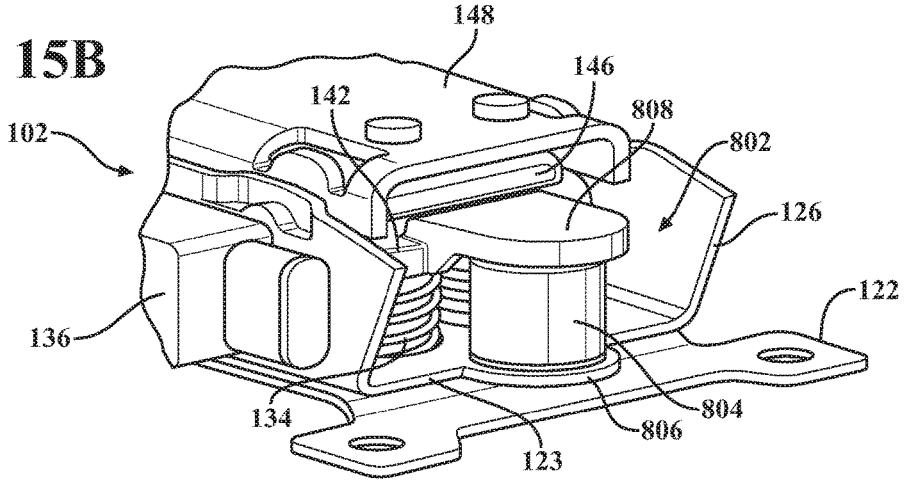
FIG. 15B illustrates a partial perspective view of a support with a control mechanism in a neutral position according to an exemplary embodiment of the present disclosure.
Figure 15C:
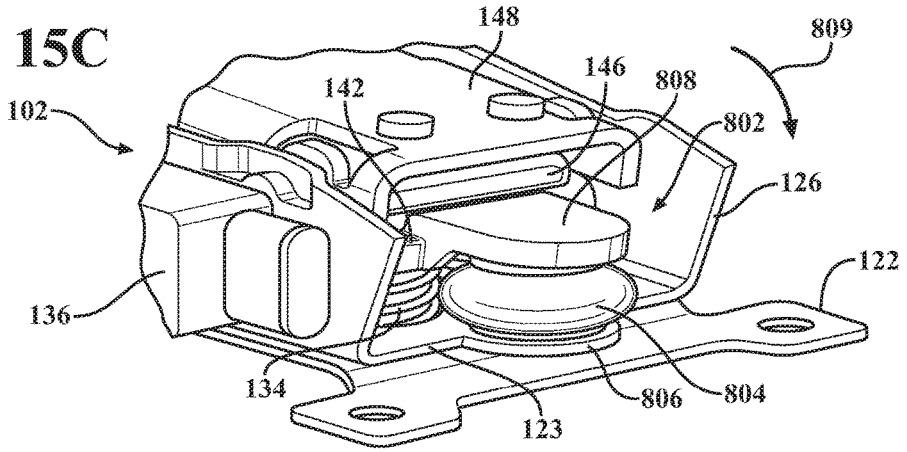
FIG. 15C illustrates a partial perspective view of a support with a control mechanism in a second operational position according to an exemplary embodiment of the present disclosure.

FIGS. 15A-15C illustrate a control mechanism 802 according to an exemplary embodiment of the present disclosure. The control mechanism 802 includes a resilient member 804 mounted within or otherwise operably coupled to the support 102. In the exemplary embodiment illustrated in FIGS. 15A-15C, the resilient member 804 is disposed on an arcuate flange 806 extending from the base 123 of the housing bracket 126. In other words, a portion of the resilient member 804 is situated on the base 123, and another portion on the arcuate flange 806. Based on the space constraints within the support 102 due to other components such as the biasing members 134 and the like, the arcuate flange 806 can provide the clearance required to position the resilient member 804 within the support 102.

The resilient member 804 is configured to be compressed to a compressed state and resiliently return to a natural state. The resilient response is associated with elastic deformation of the material from which the resilient member 804 is constructed. In at least some aspects of the embodiment, the resilient member 804 is constructed from an elastomer such as unsaturated rubber, saturated rubber, or any other type of 4S elastomer. The present disclosure contemplates any suitably resilient material can be used. Further, based on the properties of the material, particularly the Young's modulus and coefficient of restitution, the magnitude of the resilient response can be tuned to provide desired control or damping as the resilient member 804 is compressed to the compressed state as the pedal 104 pivots from the neutral position to one of the operational positions. Similarly, the magnitude of the resilient response can be tuned to provide desired force on the pedal 104 as it returns from one of the operational positions to the neutral position. The size and shape of the resilient member 804 can also influence the operational characteristics of the control mechanism 802. In the exemplary embodiment illustrated in FIGS. 15A-15C, the resilient member 804 is a cylinder, but any suitable size and shape can be used without deviating from the objects of the present disclosure.

The resilient member 804 is positioned at a desired distance from the pivot shaft 106 (not shown in FIGS. 15A-15C). Further, a second resilient member (not shown) is mounted within the support 102 on a side of the pivot shaft 106 opposite the illustrated resilient member 804. In a preferred embodiment, the resilient members 804 are equidistant from the pivot shaft 106 and comprising the same structure so as to ensure the same resilient response from the resilient member 804 as the pedal 104 is pivoted from the neutral position either one of the first operational position or the second operational position.

With continued reference to FIGS. 15A-15C, a rigid member 808 is operably coupled to the pedal 104 such that when the pedal 104 is pivoted from the neutral position to one of the operational positions, the rigid member 808 is forcibly moved. In the exemplary embodiment illustrated in FIGS. 15A-15C, the rigid member 808 is a disc-like structure operably coupled to the spring perch 142 situated atop the biasing members 134. As previously disclosed herein, pivoting of the pivot bracket 148 (via the user input to the pedal 104) moves the up stop pin 146 within the support 102. The up stop pin 146 is operably coupled to a slider block 144 (FIG. 3) slidably engaged with the spring perch 142. Consequently, the spring perch 142, and hence the rigid member 808 in the present embodiment, move based on pivoting of the pedal 104.

FIG. 15B illustrates the support 102 in the neutral position. In particular, the rigid member 808 is situated atop the resilient member 802 with the resilient member 802 in the natural state. As the pedal 104 is pivoted in a first radial direction of arrow 809 to the first operational position, the pivot bracket 148 ultimately moves the spring perch 142 to bias the biasing members 134. The movement of the spring perch 142 likewise forces the rigid member 808 to compress the resilient member 802, as illustrated in FIG. 15C. In other words, the resilient member 802 is placed into the compressed state in response to the pedal 104 moving from the neutral position to the first operational position. In the compressed state, the resilient member 804 provides the elastic or resilient response to the rigid member 808 to urge the rigid member 808, and ultimately the pedal 104, to the neutral position.

Upon returning to the neutral position, the control mechanism 802 of the exemplary embodiment of FIGS. 15A-15C minimizes overshoot, as the energy from the pedal 104 moving in a second radial direction of arrow 811 to the second operational position is absorbed by the resilient member 804 positioned opposite the resilient member 804 relative to the pivot shaft 106. In the second operational position, a gap 810 exists between the rigid member 808 and the resilient member 804, as illustrated in FIG. 15A.

In many respects, the resilient member 804 and the biasing member(s) 134 on each side of the support 102 relative to the pivot shaft 106 cooperate to urge the pedal 104 to the neutral position. Whereas the bias force from the biasing member 134 is generally a function of the distanced displaced from a natural state, the resilient member 804 can have Young's modulus configured to provide a resistive or retarding force based on the angular speed of the pivoting pedal 104 or any other desired value. Thus, the control mechanism 802 and the biasing members 134 can be designed and tuned to ensure the bidirectional pedal assembly returns to the neutral position with no overshoot within a predetermined period.

Figure 16:
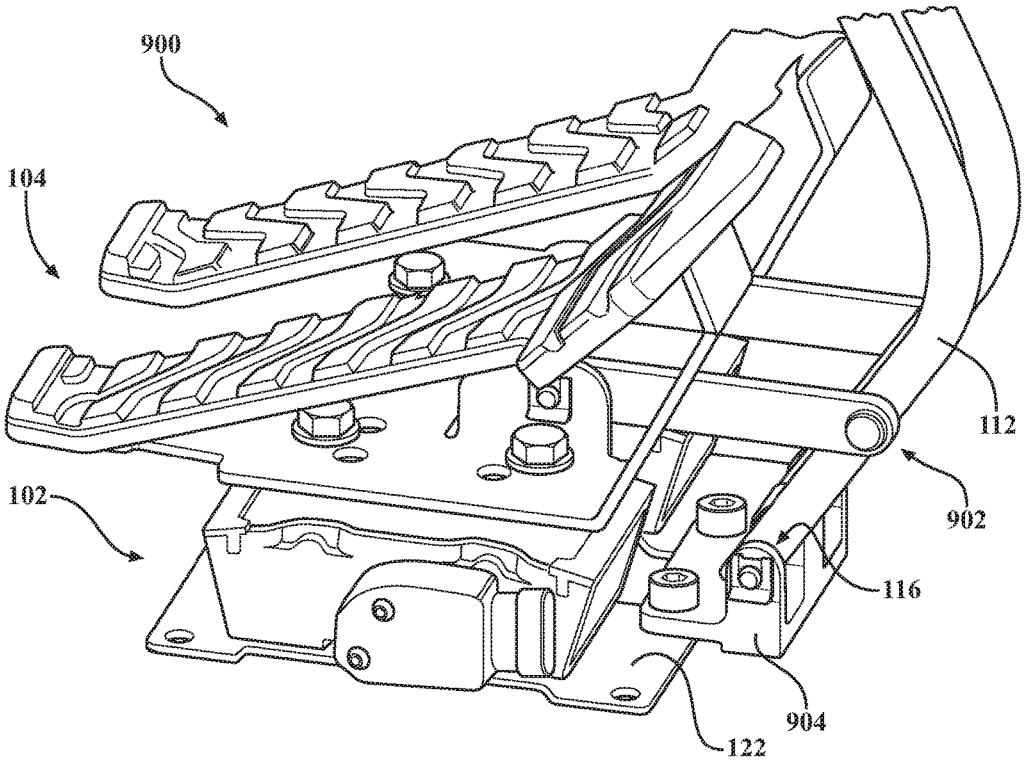
FIG. 16 illustrates a perspective view of a bidirectional pedal assembly with a linkage according to an exemplary embodiment of the present disclosure. A portion of the handles is shown.

A bidirectional pedal assembly 900 in accordance with another exemplary embodiment of the present disclosure is illustrated in FIG. 16. Whereas in previously disclosed embodiments the handle 112 was coupled to the pedal 104, the exemplary embodiment of FIG. 16 illustrates the handle 112 is coupled to the support 102. More particularly, a handle coupler 904 is connected to the mounting plate 122 of the support 102, to which the first end 116 of the handle 112 is pivotally connected. In the exemplary embodiment illustrated in FIG. 16, the handle coupler 904 is connected to the mounting plate 122 with a bolt. The present disclosure contemplates alternative means for fastening as commonly known in the art, and further contemplates the handle coupler 904 may be integrally formed with the mounting plate 122 or the support 102. Embodiments where the handle coupler 904 is not integrally formed can permit retrofitting of bidirectional pedal assemblies with handles, as disclosed below.

The handle 112 is coupled to the pedal 104 via a linkage 902. In such a configuration, the handle 112 acts as a lever arm with the first end 116 pivotally coupled to the support 102 and the second end 118 (FIG. 1) adapted to receive the user input from the operator. The linkage 902 is pivotally coupled to the handle 112 between the first end 116 and the second end.

Figure 17:
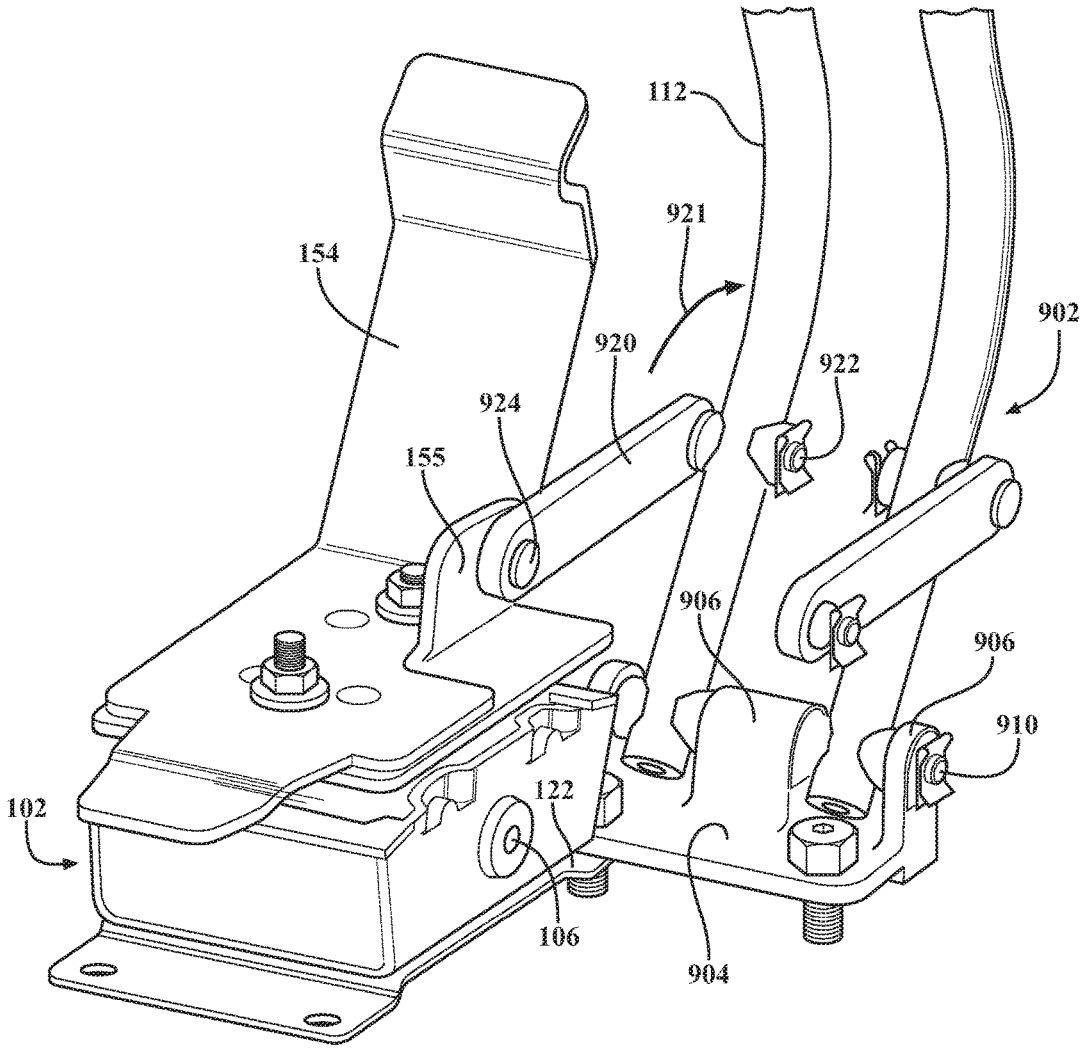
FIG. 17 illustrates a partial perspective view of a bidirectional pedal assembly with a linkage and handles according to an exemplary embodiment of the present disclosure.
Figure 18:
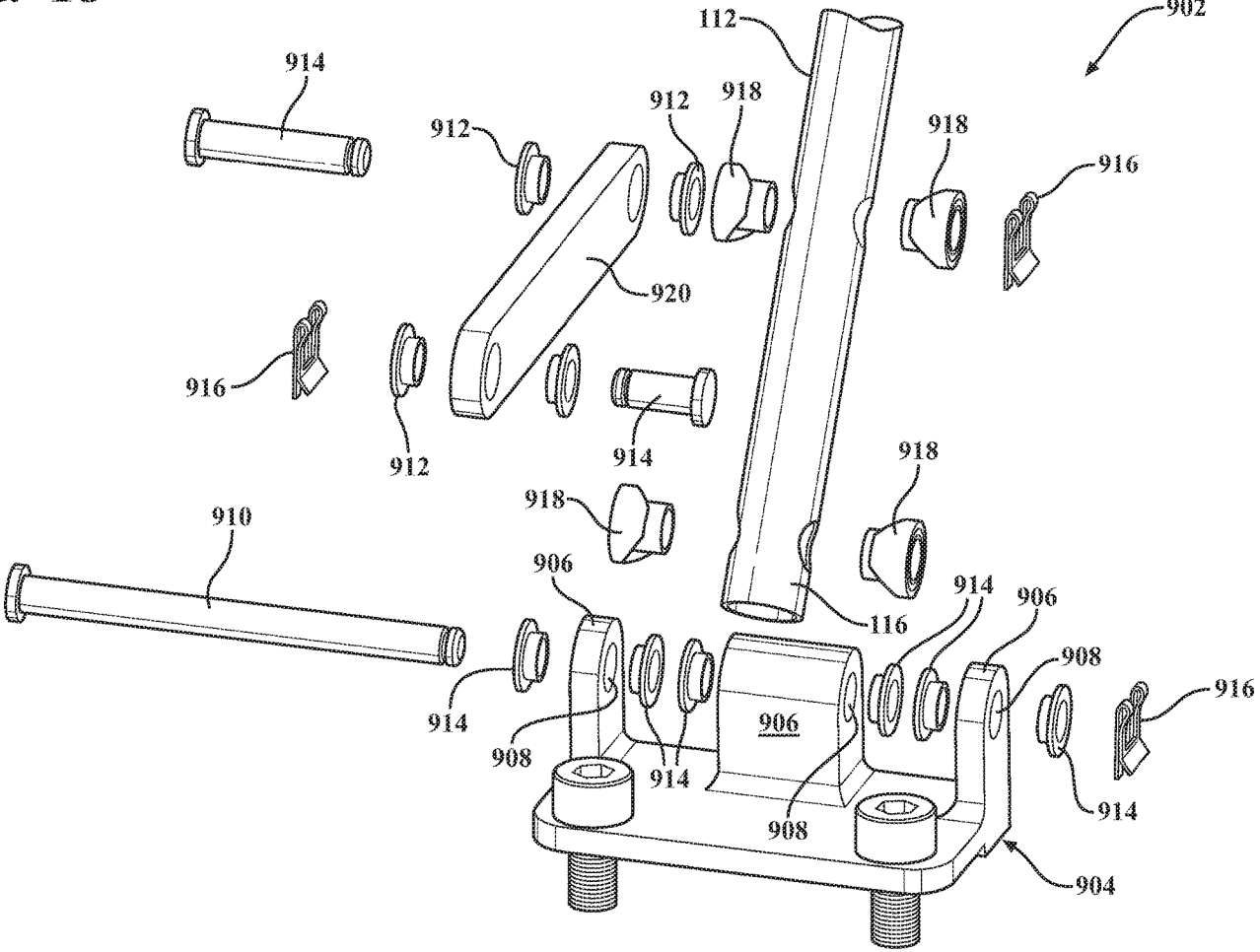
FIG. 18 illustrates an exploded view of a linkage according to an exemplary embodiment of the present disclosure.

Referring to FIGS. 17 and 18, an exemplary linkage 902 is illustrated. Again, the handle coupler 904 is configured to be secured to the mounting plate 122 of the support 102. The handle coupler 904 can include a plurality of flanges 906 spaced apart to receive the first end 116 of the handle 112 there between. Each of the flanges 906 includes an aperture 908 configured to receive a coupler pin 910. The coupler pin 910 extends through each of the flanges 906 and the handle (s) 112 pivotally coupled to the handle coupler 904. In the exemplary embodiment illustrated in FIGS. 17 and 18, the handle coupler 904 is configured to receive two handles 112, one for each bidirectional pedal assembly positioned in a side-by-side configuration. By contrast, the exemplary linkage 902 illustrated in FIG. 19 includes a handle coupler 904 configured to receive one handle 112. Any number of handles can be incorporated without deviating from the objects of the present disclosure.

Returning to FIG. 18, the linkage 902 comprises bushings 912, pins 914, clips 916, and/or spacers 918. The bushings 912 can be flanged bushings, solid sleeve bushings, or any other suitable bearing. The components maintain the structural integrity of the linkage 902 as commonly understood in the mechanical arts.

FIGS. 17 and 18 illustrate the linkage 902 comprising a primary link 920 extending between and pivotally coupled to the handle 112 and the pedal bracket 154. More specifically, the primary link 920 is pivotally coupled to a flange 155 integral with or operably coupled to the pedal bracket 154. The flange 155 is oriented vertically so as to permit use of a simple binary primary link 920, as illustrated in FIG. 17.

In operation, the operation provides the user input to the second end 118 of the handle 112. The handle 112 pivots about the pin 910 extending through the handle coupler 904 and the first end 116 of the handle 112. The pivoting of the handle 112 will impart two-part motion on the primary link 920—translational and pivotal motion. For example, if the operation was to "push" to handle 112 in the direction of arrow 921, point 922 is directed away from and lower relative to point 924. The motion results in the primarily link 920 pivoting slightly clockwise while also translating to follow the motion of the handle 112. The translation of the primary link 920 generates a torque on the pedal bracket 154 (via the flange 155) about the pivot shaft 106. The torque causes the pedal bracket 154 (and the pedal 104 affixed thereto, not shown in FIG. 17), to pivot about the pivot shaft 106. Alternatively or additionally, the user input can be applied directly to the pedal 104.

Upon release of the handle 112 (and/or the pedal 104) and removal of the input force by the operator, the biasing members 134 within the support 102 continuously bias the pedal 104 and the handle 112 to the neutral position as previously disclosed herein. Because the primary link 920 is both pivoting and translating, a component of the return force vector from the biasing member 134 is lost, thereby providing a retarding force or damping effect. Further, the linkage 920 includes the components 912, 914, 916, 918 that increase friction with movement of the bidirectional pedal assembly, at least relative to embodiments where the handle 112 is directly connected to the pedal 104. Still further, the linkage 902 relocates the center of mass of the handle 112. The compound movement, the frictional increase, and the relocated center of mass collectively slow the movement of the pedal 104 to minimize overshoot and/or oscillation of the pedal 104 about the neutral position. In effect, the linkage 902 acts as a control mechanism consistent with exemplary embodiments disclosed herein.

In the exemplary embodiment illustrated in FIG. 17, the pedal bracket 154 and the handle coupler 904 are removably secured to the support 102 with fasteners. The disclosed assembly permits existing bidirectional pedal assemblies to be retrofit with handles. Among other advantages, retrofitting with handles provides mechanical advantage as a lever arm for ease of operation, a retarding force or damping effect to minimize overshoot, and modularity for service or replacement.

Figure 19:
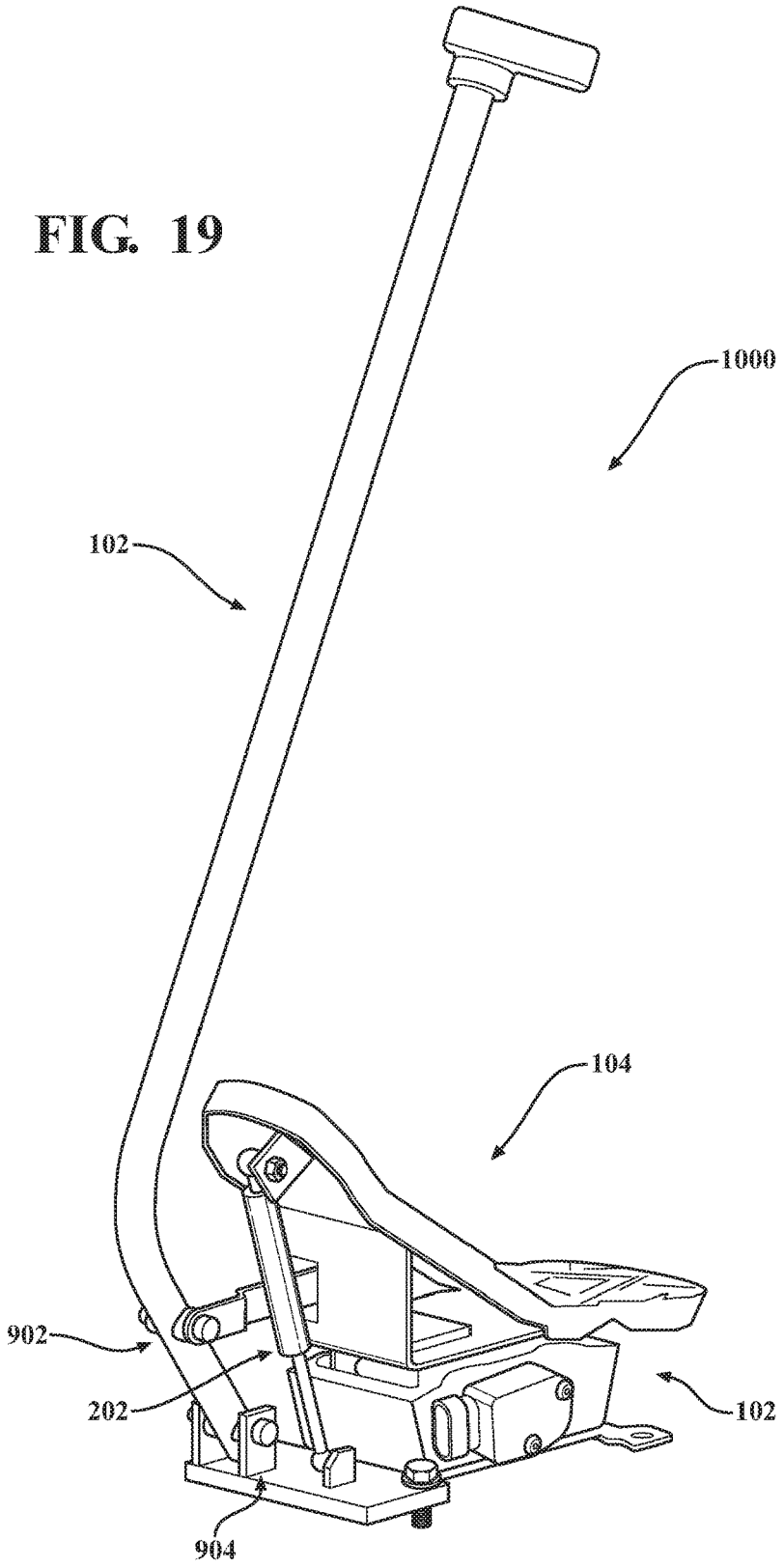
FIG. 19 illustrates a perspective view of a bidirectional pedal assembly with a linkage, handle and control mechanism according to an exemplary embodiment of the present disclosure.
Figure 20:
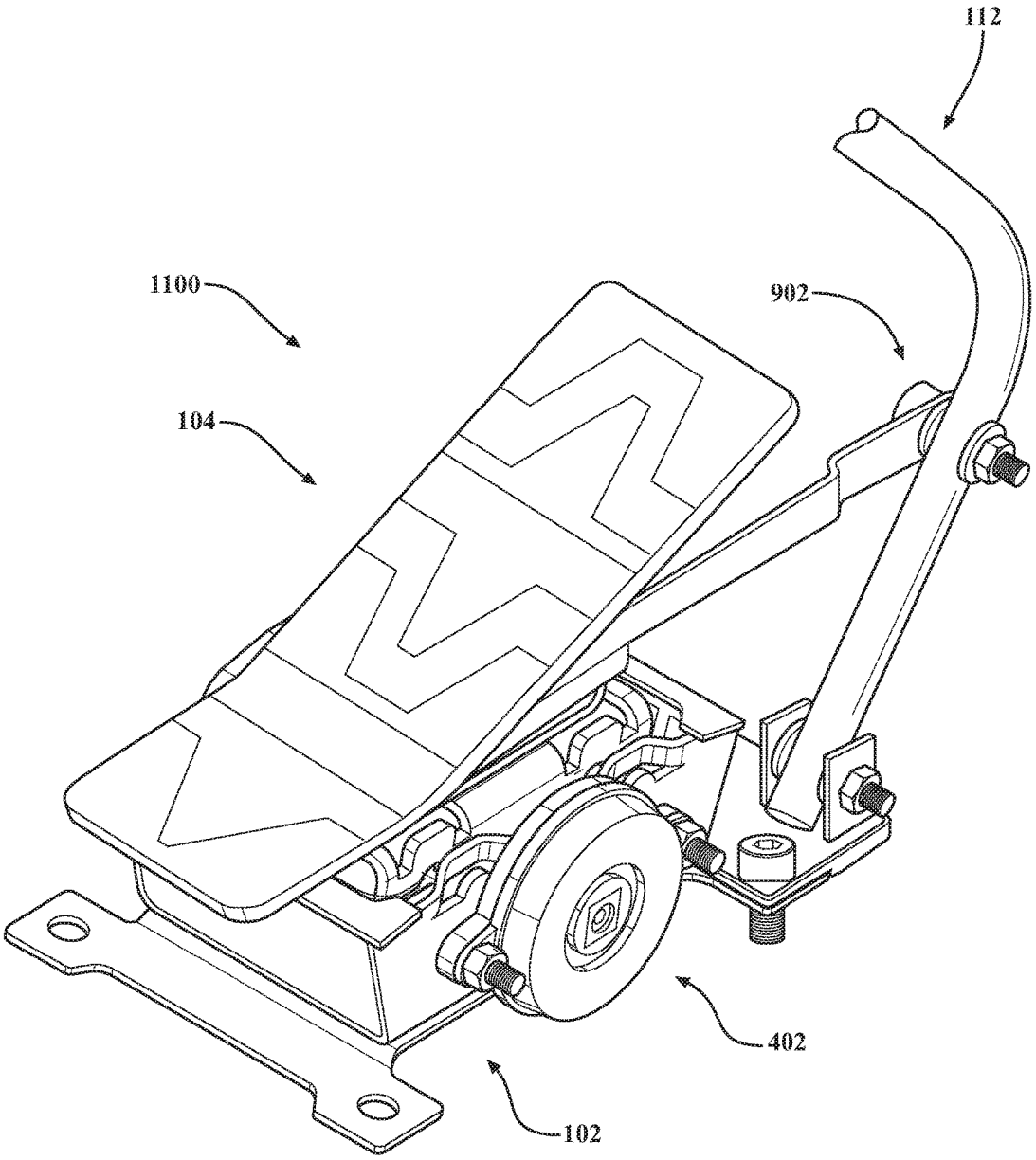
FIG. 20 illustrates a perspective view of a bidirectional pedal assembly with a linkage, handle and control mechanism according to an exemplary embodiment of the present disclosure. A portion of the handle is shown.
Figure 21:
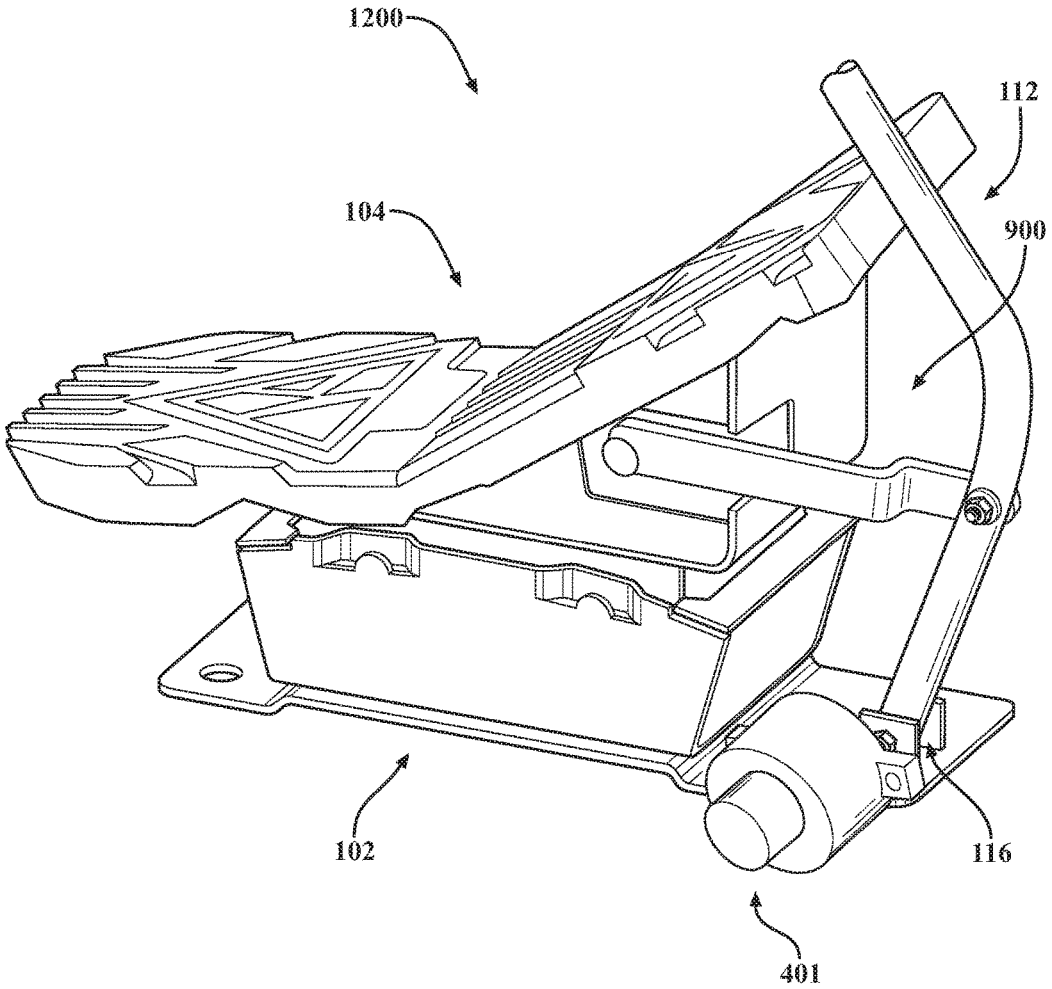
FIG. 21 illustrates a perspective view of a bidirectional pedal assembly with a linkage, handle and control mechanism according to an exemplary embodiment of the present disclosure. A portion of the handle is shown.

The control mechanism comprising a linkage 902 can be used in combination with the other exemplary control mechanisms 202, 302, 402, 502, 602, 702, 802 of the present disclosure. In other words, the linkage 902 as a control mechanism can supplement the retarding effects provided by the other control mechanisms. In such configurations, a smaller primary control mechanism can be used (e.g., linear damper, rotary damper, center brake) without loss of damping efficiency. Exemplary embodiments using more than one control mechanism are illustrated in FIGS. 19-21. In FIG. 19, a bidirectional pedal assembly 1000 includes the linear control mechanism 202 (FIG. 4) and the linkage control mechanism 902 each operably coupled to the support 102 and the pedal 104. FIG. 20 illustrates a bidirectional pedal assembly 1100 including the rotary control mechanism 402 (FIGS. 6A and 6B) and the linkage control mechanism 902 each operably coupled to the support 102 and the pedal 104. FIG. 21 illustrates a bidirectional pedal assembly 1200 including linkage control mechanism 902 operably coupled to the support 102 and the pedal 104. A control mechanism 401 can include a rotary damper or any other suitable control mechanism previously disclosed herein. Whereas the control mechanism 401 of FIGS. 6A, 6B and 20 illustrate a rotary damper operably coupled to the pivot shaft 106, FIG. 21 illustrates the control mechanism 401 coupled to the pivot point associated with the first end 116 of the handle 112.

Methods for operating a bidirectional pedal assembly in accordance with exemplary embodiments of the present disclosure are also provided. As disclosed herein, the bidirectional pedal assembly comprises the support 102 mounted on a vehicle, the pivot shaft 106 disposed within the support 102, the pedal 104 pivotally coupled to the support 102 about the pivot shaft 106, a handle operably coupled to the pedal, a biasing member 134 mounted within the support, and a control mechanism 202, 302, 402, 502, 602, 702, 802, 902 coupled to the support 102 and the pedal 104. One of the pedal 104 and the handle 112 is depressed to pivot both of the pedal 104 and the handle 112 in a first radial direction 158 from a neutral position. The biasing member 134 is biased as the pedal 104 and the handle 112 concurrently move away from the neutral position. The biasing member 134 urges the pedal 104 and the handle 112 in a second radial direction 159 opposite the first radial direction 158. The pedal 104 or the handle 112 is released by the operator to permit both of the pedal 104 and the handle 102 to pivot in the second radial direction 159 under the influence of the biasing member 134. The movement of the pedal 104 and the handle 112 are retarded in both the first radial direction 158 and the second radial direction 159 with the control mechanism 202, 302, 402, 502, 602, 702, 802, 902. A magnitude of the retarding movement can be based, at least in part, on rotational speed of the pedal 104 and the handle 112.

The bidirectional pedal assembly can further comprise a frictional mechanism 140 disposed within the support 102. The frictional mechanism 140 provides increasing resistance to the pedal 104 as the pedal 104 moves increasingly away from the neutral position.

In at least some aspects of the present disclosure, the control mechanism 202, 302, 402, 502, 602, 702, 802, 902 and the frictional mechanism 140 provide a retarding force in the second radial direction 159 as the pedal 104 and the handle 112 are pivoted in the first radial direction 158. However, only the control mechanism 202, 302, 402, 502, 602, 702, 802, 902 provides a retarding force in the first radial direction 158 as the pedal 104 and the handle 112 return to the neutral position in the second radial direction 159. Stated differently, as the pedal 104 moves from the neutral position to one of the operational positions, the frictional mechanism 140 and the control mechanism 202, 302, 402, 502, 602, 702, 802, 902 each provide a retarding force. Yet as the pedal 104 moves from the one of the operational positions to the neutral position, the control mechanism 202, 302, 402, 502, 602, 702, 802, 902 provides another retarding force and the frictional mechanism 140 does not provide another retarding force.

In at least some aspects of the present disclosure, the biasing member 134, the control mechanism 202, 302, 402, 502, 602, 702, 802, 902, and the frictional mechanism 140 provide a retarding force in the second radial direction 159 as the pedal 104 and the handle 112 are pivoted in the first radial direction 158.

Exemplary methods can further comprise returning the pedal 104 to the neutral position with no overshoot within a predetermined period under the influence of the biasing member 134 and the control mechanism 202, 302, 402, 502, 602, 702, 802, 902. Relative angular position can be maintained between the pedal 104 and the handle 112 as the pedal 104 and the handle 112 pivot in the first radial direction 158 and the second radial direction 158. In other aspects of the present disclosure, the biasing member 134, the control mechanism 202, 302, 402, 502, 602, 702, 802, 902 and/or the frictional mechanism 140 can perform the above method steps without a handle 112 comprising a component of the bidirectional pedal assembly.

The disclosure has been described in an illustrative manner, and it is to be understood that the terminology which has been used is intended to be in the nature of words of description rather than of limitation. As is now apparent to those skilled in the art, many modifications and variations of the subject disclosure are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A bidirectional pedal assembly for a vehicle comprising:

a support configured to be mounted on the vehicle;

a pivot shaft disposed within said support;

a pedal pivotally coupled to said support about said pivot shaft between a neutral position, a first operational position, and a second operational position opposite said first operational position relative to said neutral position;

a handle operably coupled to said pedal and configured to pivot concurrently with said pedal;

a biasing member mounted within said support and continuously biasing said pedal to said neutral position; and a control mechanism coupled to said support and said pedal to permit pivotal moment of said pedal and said handle from said neutral position to each of said first and second operational positions, and to provide a retarding force to retard the pivotal movement of said pedal and said handle as said pedal and said handle move from each of said first and second operational positions to said neutral position, wherein a magnitude of said retarding force is based on rotational speed of said pedal as said pedal returns from said first and second operational positions to said neutral position.

2. The bidirectional pedal assembly of claim 1, wherein said biasing member and said control mechanism are configured to force said pedal to said neutral position within a predetermined period.

3. The bidirectional pedal assembly of claim 1, wherein said pedal further comprises a first portion, a second portion and an intermediate portion disposed between said first and second portions with said intermediate portion coupled to said pivot shaft, said first portion extending in a first direction from said intermediate portion to pivot said pedal about said pivot shaft from said neutral position to said first operational position in response to a user input, and said second portion extending in a second direction from said intermediate portion to pivot said pedal about said pivot shaft from said neutral position to said second operational position in response to the user input, thereby defining bidirectional movement of said bidirectional pedal assembly.

4. The bidirectional pedal assembly of claim 3, wherein said handle comprises an elongated member having a first end operably coupled to said pedal proximate said first portion of said pedal, and a second end opposite said first end.

5. The bidirectional pedal assembly of claim 4, wherein said pedal and said elongated member are rigidly connected.

6. The bidirectional pedal assembly of claim 1, wherein:

said handle is a lever arm having a first end pivotally coupled to said support and a second end opposite said first end and adapted to receive a user input, and further comprising a linkage pivotally coupled to said pedal and to said handle between said first end and said second end.

7. The bidirectional pedal assembly of claim 1, wherein said handle includes an initial position when said pedal is in said neutral position, wherein, as said pedal moves from said neutral position to one of said operational positions said handle is angularly displaced with said angular movement of said handle from said initial position is substantially equal to angular movement of said pedal from said neutral position.

8. The bidirectional pedal assembly of claim 1, wherein said control mechanism is a linear damper operably coupled to said support and said pedal.

9. The bidirectional pedal assembly of claim 3, wherein said control mechanism is a linear damper operably coupled to said support and said pedal proximate one of said first portion of said pedal and said second portion of said pedal.

10. The bidirectional pedal assembly of claim 1, wherein said control mechanism is a rotary damper operably coupled to said pivot shaft.

11. The bidirectional pedal assembly of claim 1, wherein said control mechanism further comprises:

a transverse biasing member disposed about said pivot shaft;

a brake cup disposed about said pivot shaft, radially fixed relative to said support, and configured to move axially along said pivot shaft under influence of said transverse biasing member;

a brake plate positioned in contact with said brake cup and configured to pivot with said pedal;

wherein each of said brake cup and brake plate comprise counterposing surfaces configured to provide resistance as said pedal is pivoted from said neutral position to one of said first operational position and said second operational position.

12. The bidirectional pedal assembly of claim 11, wherein said counterposing surfaces are sinusoidal.

13. The bidirectional pedal assembly of claim 11, further including a brake housing mounted to said support, disposed about said pivot shaft, and configured to radially secure said brake cup to said support.

14. The bidirectional pedal assembly of claim 1, wherein said control mechanism comprises:

a rigid member operably coupled to said pedal; and a resilient member operably coupled to said support with said resilient member providing an elastic response to said rigid member to urge said pedal to said neutral position.

15. The bidirectional pedal assembly of claim 10, wherein said rotary damper is disposed within said support.

16. The bidirectional pedal assembly of claim 1, further comprising:

a frictional mechanism disposed within said support and providing increasing resistance to said pedal as said pedal moves increasingly away from said neutral position to one of said operational positions.

17. The bidirectional pedal assembly of claim 1, wherein said biasing member further comprises a first spring element and a second spring element each disposed within said support, said pivot shaft positioned intermediate said first spring element and said second spring element such that said first spring element continuously biases said pedal to said neutral position when said pedal is in said first operational position, and said second spring element continuously biases said pedal to said neutral position when said pedal is in said second operational position.

18. A bidirectional pedal assembly for a vehicle comprising:

a support configured to be mounted on the vehicle;

a pivot shaft disposed within said support;

a pedal pivotally coupled to said support about said pivot shaft between a neutral position, a first operational position, and a second operational position opposite said first operational position relative to said neutral position;

a biasing member mounted within said support and continuously biasing said pedal to said neutral position;

a frictional mechanism disposed within said support and providing increasing resistance to said pedal as said pedal moves increasingly away from said neutral position to one of said first operational position and said second operational position; and a control mechanism coupled to said support and said pedal to permit pivotal moment of said pedal from said neutral position to each of said first and second operational positions, and to provide a retarding force to retard the pivotal movement of said pedal as said pedal moves from each of said first and second operational positions to said neutral position, wherein a magnitude of said retarding force is based on rotational speed of said pedal as said pedal returns from said first and second operational positions to said neutral position.

19. The bidirectional pedal assembly of claim 18, further comprising:

a handle coupled to said pedal, wherein each of said handle and said pedal are configured to receive an input of an operator to concurrently pivot said handle and said pedal.

20. The bidirectional pedal assembly of claim 18, wherein said biasing mechanism, said frictional mechanism, and said control mechanism are configured to force said pedal to said neutral position within a predetermined period.

21. The bidirectional pedal assembly of claim 18, wherein said frictional mechanism further comprises:

a spring perch;

a slider block in abutment with said spring perch; and a up stop pin operably coupled to said slider block and said pedal, wherein, as said pedal moves from said neutral position to one of said operational positions, said up stop pin causes said slider block to slidably engage said spring perch with said increasing resistance, thereby defining a hysteresis system of said bidirectional pedal assembly.

22. The bidirectional pedal assembly of claim 18, wherein, as said pedal moves from said neutral position to one of said operational positions, said frictional mechanism and said control mechanism each provide a retarding force.

23. The bidirectional assembly of claim 22, wherein, as said pedal moves from said one of said operational positions to said neutral position, said control mechanism provides another retarding force and said frictional mechanism does not provide another retarding force.

24. A method of operating a bidirectional pedal assembly comprising a support mounted on a vehicle, a pivot shaft disposed within said support, a pedal pivotally coupled to said support about said pivot shaft, a handle operably coupled to said pedal, a biasing member mounted within said support, and a control mechanism coupled to said support and said pedal, the method comprising the steps of:

depressing one of said pedal and said handle to pivot both of said pedal and said handle in a first radial direction from a neutral position;

biasing said biasing member as said pedal and said handle concurrently move away from said neutral position with said biasing member urging said pedal and said handle in a second radial direction opposite said first radial direction;

releasing one of said pedal and said handle to permit both of said pedal and said handle to pivot in said second radial direction under the influence of said biasing member;

depressing one of said pedal and said handle to pivot both of said pedal and said handle in said second radial direction from said neutral position;

biasing said biasing member as said pedal and said handle concurrently move away from said neutral position with said biasing member urging said pedal and said handle in said first radial direction; and retarding movement of said pedal and said handle in both said first radial direction and said second radial direction with said control member with a magnitude of retarding movement based on rotational speed of said pedal as said pedal and said handle return from each of said first and second radial directions to said neutral position.

25. The method of claim 24, wherein the magnitude of said retarding movement is based, at least in part, on the rotational speed of said pedal and said handle as said pedal and said handle return in one of said first and second radial directions to said neutral position.

26. The method of claim 24, wherein said bidirectional pedal assembly further comprises a frictional mechanism disposed within said support, said method further comprising the step of:

providing increasing resistance to said pedal with said frictional mechanism as said pedal moves increasingly away from said neutral position.

27. The method of claim 26, wherein said control mechanism and said frictional mechanism provide a retarding force in said second radial direction as said pedal and said handle are pivoted in said first radial direction.

28. The method of claim 26, wherein said biasing member, said control mechanism, and said frictional mechanism provide a retarding force in said second radial direction as said pedal and said handle are pivoted in said first radial direction.

29. The method of claim 26, wherein only said control mechanism provides a retarding force in said first radial direction as said pedal and said handle return to said neutral position in said second radial direction.

30. The method of claim 27, further comprising the step of varying a magnitude of said retarding force based, at least in part, on rotational speed of said pedal and said handle.

31. The method of claim 24, further comprising the step of returning said pedal to said neutral position within a predetermined period under the influence of said biasing member and said control mechanism.

32. The method of claim 24, further comprising the step of maintaining relative angular position between said pedal and said handle as said pedal and said handle pivot in said first radial direction and said second radial direction.

* * * * *